US008311471B2

(12) United States Patent
Yamada

(10) Patent No.: US 8,311,471 B2
(45) Date of Patent: Nov. 13, 2012

(54) IMAGE FORMING APPARATUS

(75) Inventor: Toshiyuki Yamada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 276 days.

(21) Appl. No.: 12/853,893

(22) Filed: Aug. 10, 2010

(65) Prior Publication Data

US 2011/0038654 A1 Feb. 17, 2011

(30) Foreign Application Priority Data

Aug. 17, 2009 (JP) ..... 2009-188457

(51) Int. Cl.
*G03G 15/20* (2006.01)

(52) U.S. Cl. ..... 399/341; 399/401; 399/328

(58) Field of Classification Search ..... 399/341, 399/328, 401
See application file for complete search history.

(56) References Cited

U.S. PATENT DOCUMENTS

| | | | | |
|---|---|---|---|---|
| 5,260,753 | A | 11/1993 | Haneda et al. | 355/282 |
| 6,535,712 | B2 * | 3/2003 | Richards | 399/341 |
| 7,813,006 | B2 * | 10/2010 | Liu et al. | 358/3.06 |
| 2005/0128523 | A1 * | 6/2005 | Liu et al. | 358/3.06 |

FOREIGN PATENT DOCUMENTS

| | | |
|---|---|---|
| JP | 4-338984 | 11/1992 |
| JP | 10-133515 | 5/1998 |
| JP | 3030576 | 4/2000 |
| JP | 2009-109926 | 5/2009 |

* cited by examiner

*Primary Examiner* — David Gray
*Assistant Examiner* — G. M. Hyder
(74) *Attorney, Agent, or Firm* — Fitzpatrick, Cella, Harper & Scinto

(57) ABSTRACT

An image forming apparatus forms a gloss mark with colored toner without using clear toner. This is accomplished by fixing an image composed of only part of the color toner required for forming an image, the rest of the required color toner being denoted as residual toner. Specifically, at an area of at which a decreased gloss is desired, an image is formed using a part of colored toner required for forming the image and fixed on a sheet, and then, applied to the sheet is the residual quantity of toner so as to be superimposed on the fixed colored toner.

2 Claims, 24 Drawing Sheets

IMAGE FORMING APPARATUS

BACKGROUND OF THE INVENTION

1. Field of the Invention

The present invention relates to an image forming apparatus capable of outputting an image having relatively heightened glossiness at a part of the image to be output.

2. Description of the Related Art

Recently, there has been a demand to adjust the glossiness of a print product to be output as well as to improve image quality thereof. For example, an expression method called a gloss mark method to express a figure and a character by heightening glossiness at a desired area with a gloss difference against other areas has been known.

Such a figure drawn with a gloss difference (hereinafter, called a gloss mark) cannot be copied by a copying machine which performs copying as a reading density of a printed image. Because of the difficulty of being copied (i.e., high original assurance), a gloss mark is sometimes called a security mark. Further, since an area having different gloss can be formed purposely on an output image of one sheet with a gloss mark, a desired position can be distinguished. Therefore, the expression boundaries of a print product can be expanded.

A configuration to use clear toner without a pigment at an area of which gloss is desired to be heightened in order to form such a gloss mark on a sheet has been discussed in Japanese Patent Application Laid-Open No. 4-338984. By mounting clear toner on the area having gloss to be heightened (i.e., a gloss mark part), gloss can be heightened. Further, by changing the clear toner quantity used at the gloss mark part, the gloss mark is formed to be distinguished or formed not to be distinguished according to a user's wishes.

However, with the configuration of Japanese Patent Application Laid-Open No. 4-338984 to utilize clear toner for outputting a gloss mark, it is necessary to prepare clear toner in addition to colored toner. Further, a storage container, a supply mechanism and a development device are necessary for clear toner. Accordingly, such an image forming body has an increased size in addition to an increased manufacturing cost.

SUMMARY OF THE INVENTION

To address the above issues, the present invention provides an image forming apparatus capable of preparing a gloss mark by controlling glossiness at a desired image area while maintaining a color phase without utilizing clear toner.

Specifically, the present invention provides an image forming apparatus including an image forming portion which forms an image with colored toner on a sheet, a fixing device which fixes the image formed on the sheet, an obtaining unit which obtains an area of which glossiness is to be heightened in the image formed on the sheet, and a control unit which controls the apparatus to form the image on the sheet with a first process to transfer and fix, onto the sheet, a part of toner for image forming when forming the image on the sheet and a second process to transfer and fix, onto a face of the sheet having the image formed with the first process, a part of toner for image forming, wherein the control unit performs control so that the ratio of toner quantity formed in the second process at the area obtained by the obtaining unit to the toner quantity formed in the first process at the area obtained by the obtaining unit is to be greater than the ratio of toner quantity formed in the second process at an area excluding the area obtained by the obtaining unit to the toner quantity formed in the first process at the area excluding the area obtained by the obtaining unit.

Further features of the present invention will become apparent from the following description of exemplary embodiments with reference to the attached drawings.

DESCRIPTION OF THE EMBODIMENTS

In the following, the present invention will be specifically described with reference to embodiments. The embodiments are exemplary embodiments of the present invention and the present invention is not limited to the embodiments.

[First Embodiment]

(1) Overall Description of Example of Image Forming Apparatus

Figure 1A:
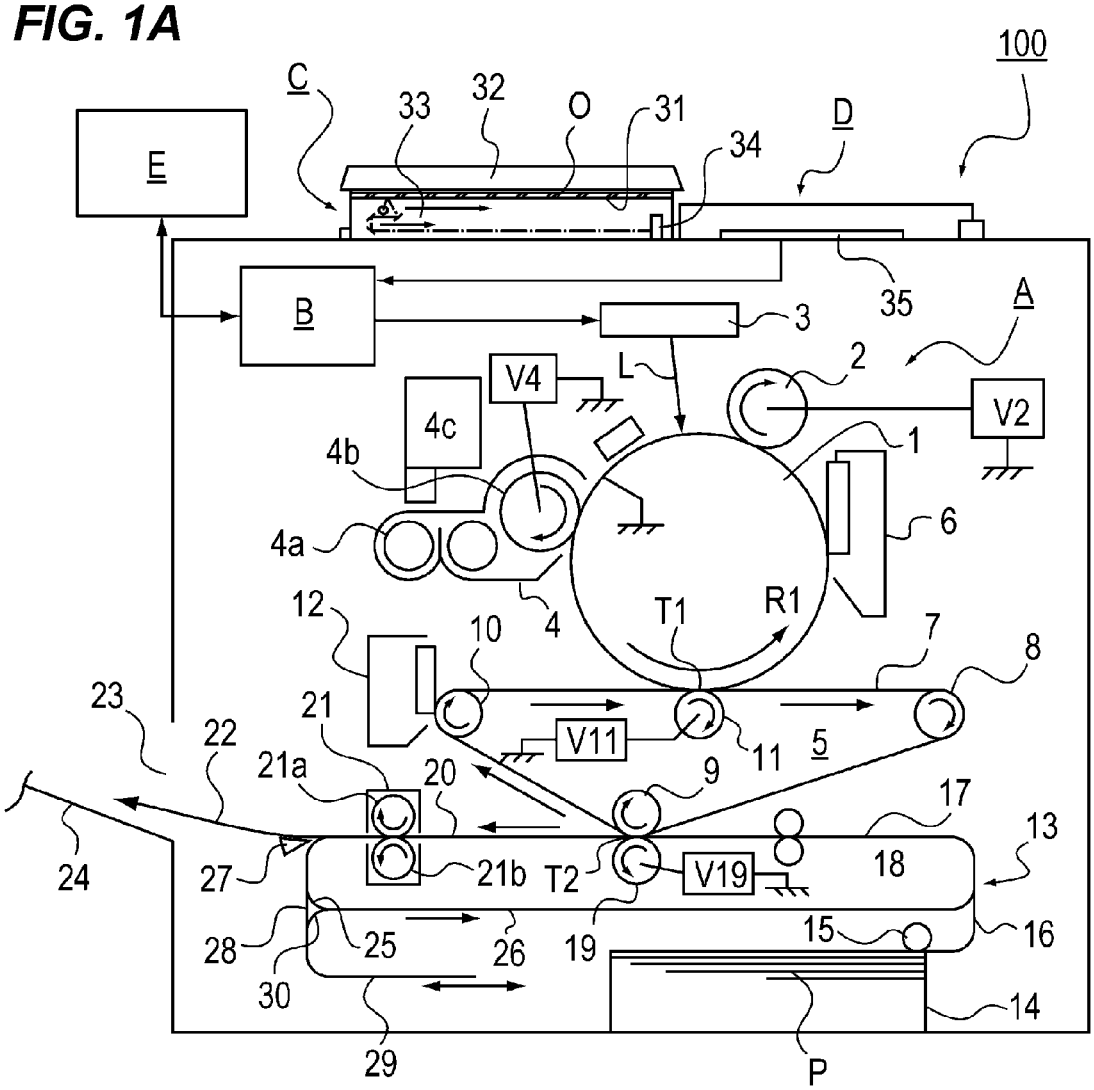
FIG. 1A is a schematic sectional view of an image forming apparatus according to a first embodiment.
Figure 1B:
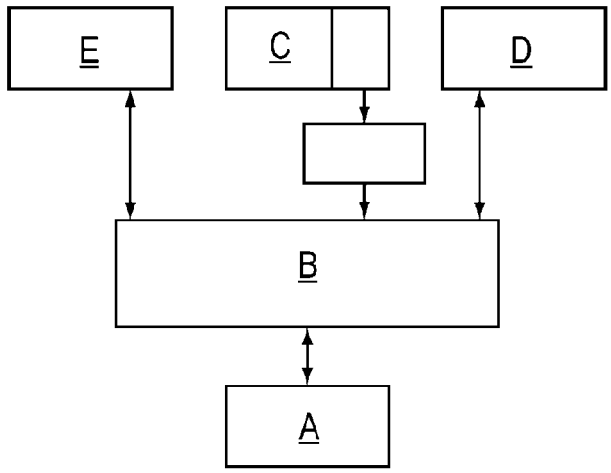
FIG. 1B is a block diagram of a control system of the image forming apparatus.

FIG. 1A is a schematic sectional view of an image forming apparatus of an embodiment according to the present invention. FIG. 1B is a block diagram of a control system. The image forming apparatus (hereinafter, abbreviated as the apparatus) 100 is a digital-monochrome image forming apparatus of an electrophotographic system being a multifunctional machine functioning as a copying machine, a printer and a facsimile machine. An image forming portion A to output a monochrome toner image formed on a recording material (i.e., a recording medium) P with an electrophotographic process and a controller (i.e., control unit, a control circuit portion and a control substrate portion) B are arranged at the inside of the apparatus 100. An original reading portion (i.e., an image scanner, hereinafter, abbreviated as a scanner) C and an operation display portion (hereinafter, abbreviated as an operation portion) D are arranged at the upper face side of the apparatus 100. The operation portion D performs to input commands from an operator and to notify an operator of apparatus conditions. An external input device (i.e., an external host device) E, such as a personal computer and a facsimile machine, is connected to the controller B via an interface. The controller B performs to exchange diverse electrical information with the operation portion D and the host device E and totally controls an image forming operation of the image forming portion A corresponding to a predetermined control program and a reference table. The scanner C is a device to photoelectrically read an original image including an original base plate glass 31, an original pressing plate 32 capable of being opened and closed against the glass 31, a moving optical system 33 for light scanning, and a CCD 34, being a photoelectric conversion element (i.e., a solid-state image pickup element). An original O is placed pursuant to predetermined placing instructions as an image face to be read being faced downward to the upper face of the glass 31, and then, is set by being covered by the pressing plate 32 thereon. It is also possible to automatically feed a sheet-shaped original on the glass 31 by adopting an automatic original feeding apparatus (ADF, RDF) as the pressing plate 32. The moving optical system 33 is driven to move along the lower face of the glass 31 based on a reading start signal, so that the faced-down image face of the original O is optically scanned. The document scanned light forms an image at the CCD 34 so as to be photoelectrically read. The read image signal is input to the image processing portion 35 and the image-processed image data (i.e., an electric image data) is input to the controller B.

In a copy mode (i.e., an original copying mode), the controller B controls an operation of the image forming portion A so that a toner image corresponding to the image data of the original image photoelectrically read by the scanner C is output as being formed at a recording material P. An operation in the copy mode is performed by pushing a copy start key 400 (see FIG. 2B) after setting the original O at the scanner C and setting desired copy conditions by the operation portion D. In a print mode, the controller B controls the operation of the image forming portion A so that a toner image corresponding to image data input from a personal computer being the host device E is output as being formed at a recording material P. In a facsimile receiving mode, the controller B controls the operation of the image forming portion A to receive a toner image corresponding to image data output from a counterpart facsimile machine as the host device E. In a facsimile sending mode, the controller B transmits the image data of the original image photoelectrically read by the scanner C to the counterpart facsimile machine.

The image forming portion A includes an electrophotographic photosensitive drum (hereinafter, abbreviated as a drum)_1 as a rotatable image bearing member having a latent image (i.e., an electrostatic latent image) formed thereon. The drum 1 is driven to rotate in the counterclockwise direction of the arrow R1 at a predetermined circumferential speed (i.e., process speed). A charging portion 2, an exposure portion 3, a development portion 4, a transfer portion 5, and a drum cleaning portion 6 are arranged around the drum 1 sequentially along the drum rotating direction as an electrophotographic process unit working on the drum 1. In the present embodiment, the charging portion 2 is a contact charging roller. The roller 2 is arranged approximately in parallel to the drum 1 to be contacted to the drum 1 with a predetermined pressing force so as to be driven with rotation of the drum 1. A predetermined charging bias is applied to the roller 2 from a power supply portion V2 at a predetermined control timing. Accordingly, the outer circumferential face of the rotating drum 1 is evenly charged at a predetermined polarity and potential. The exposure portion 3 is a unit to form a latent image corresponding to image data on the drum surface by digitally exposing the evenly charged surface of the drum 1. The exposure portion 3 is a laser scanning mechanism (i.e., a laser scanner) as a digital exposure device. Not being illustrated in the drawings, the exposure portion 3 includes a light source device (a laser), a polygon mirror, a reflection mirror and an fθ lens. The light source device emits laser light modulated corresponding to the image data input from the controller B. In the mechanism 3, the rotating polygon mirror is scanned with laser light emitted from the light source device and light flux of the scanning light is polarized by the reflection mirror. Then, digital exposure L is performed by the fθ lens as collecting light onto a generating line of the drum 1. Accordingly, a latent image corresponding to the image data is formed on the surface of the drum 1. The latent image formed on the drum surface is developed by the development portion 4 as a black toner image. The development portion 4 is a unit to visualize the latent image on the surface of the drum 1 with toner having a potential by applying predetermined development bias thereto. For example, the development portion is a magnetic single-component non-contact development device. The development device 4 includes a developer container 4*a* storing magnetic single-component black toner (i.e., charged color particles) as a developer. Further, the development device 4 includes a developing roller (i.e., a developing sleeve) 4*b* rotatably arranged at an opening part of the container 4*a* facing to the drum 1 as a developer bearing member to develop a latent image by supplying toner to the drum 1. In addition, the development device 4 includes a supply device 4*c* to supply toner to the container 4*a*. The developing roller 4*b* is driven to rotate in the clockwise direction of the arrow at a predetermined circumferential speed.

Further, predetermined development bias is applied from a power supply portion V4 to the developing roller 4*b* at a predetermined control timing. Accordingly, toner having been charged to a predetermined polarity is attached to the surface of the drum 1 corresponding to a latent image pattern, so that the latent image is developed as a toner image. Here, the toner has a polyester base resin. Although toner can be manufactured with a grinding method, a method to directly manufacture toner in a medium (i.e., a polymerization method) such as a suspension polymerization method, an interfacial polymerization method and a dispersion polymerization method are preferable for a method for manufacturing toner. However, the components and the manufacturing method of toner are not limited to the above. Not limited to the magnetic single-component non-contact development type, the development device 4 may adopt a magnetic single-component contact development type, a non-magnetic single-component non-contact development type, a non-magnetic single-component contact development type or a two-component development type. Further, a combination of a background exposure type and a normal development type or a combination of an image exposure type and an inverted development type is utilized for a combination of a latent image forming method and a development method for the drum 1 respectively exploiting a characteristic thereof. With the former, exposure is performed on the surface of the charged drum 1 corresponding to a background part of image information (i.e., the background exposure type) and parts other than the background part are developed (i.e., the normal development type). On the contrary, with the latter, exposure is performed corresponding to an image information part (i.e., the image exposure type) and non-exposure parts are developed (i.e., the inversed development type).

In the present embodiment, the transfer portion 5 is an intermediate transfer belt mechanism. The mechanism 5 includes an endless belt 7 made of a flexible dielectric as an intermediate transfer member. Further, the mechanism 5 includes a drive roller 8, a secondary transfer counter roller 9 and a tension roller 10 to tensionally turn the belt 7. In addition, the mechanism 5 includes a primary transfer roller 11 being pressure-contacted to the drum 1 via the belt 7. An abutment portion between the drum 1 and the belt 7 is a primary transfer nip portion T1. Further, the mechanism 5 includes a secondary transfer roller 19 being pressure-contacted to the roller 9 via the belt 7. An abutment portion between the belt 7 and the roller is a secondary transfer nip portion T2. A belt cleaning device 12 is arranged at a belt turning part of the roller 10. The belt 7 is moved to circulate at a circumferential speed corresponding to the rotational circumferential speed of the drum 1 in the clockwise direction of the arrow being in a forward direction to the rotational direction of the drum 1 by being driven to rotate by the roller 8. A primary transfer bias of a predetermined voltage having a polarity opposite to toner charged polarity is applied to the roller 11 from a power supply portion V11 at a predetermined control timing. Accordingly, the toner image on the drum 1 is primarily transferred sequentially to the surface of the belt 7 at the nip portion T1 due to the electric field and the nip pressure. The cleaning portion 6 eliminates toner from the surface of the drum 1 remaining after transferring the toner image to the belt 7, and then, the surface of the drum 1 is repeatedly utilized for image forming. In the present embodiment, the cleaning portion 6 is a blade cleaning device. The toner image transferred to the belt 7 at the nip portion T1, is conveyed to the nip portion T2 due to subsequent movement of the belt 7. Meanwhile, a feed roller 15 of a recording material feeding portion arranged below the mechanism 5 is driven at a predetermined control timing, so that a sheet of the recording material P stacked and stored in a cassette portion 14 is fed and separated from the stack. The recording material P is conveyed from a conveying path 16 to the nip portion T2 in synchronization with arriving of the toner image on the belt 7 to the nip portion T2 after passing through a conveying path 17 which has a registration roller 18. While the recording material P is conveyed through the nip portion T2 to be nipped, a secondary transfer bias of a predetermined voltage having a polarity opposite to toner charged polarity is applied to the roller 19 from a power supply portion V19 at a predetermined control timing. Accordingly, the toner image on the belt 7 is secondarily transferred sequentially to the surface of the recording material P at the nip portion T2 due to the electric field and the nip pressure. The belt cleaning device 12 eliminates toner from the surface of the belt 7 that remains after transferring the toner image to the recording material P, and then, the surface of the belt 7 is repeatedly utilized for image forming. In the present embodiment, the belt cleaning device 12 is a blade cleaning device. The recording material P having passed through the nip portion T2 is detached from the belt 7 and is guided to a fixing device 21 as a fixing unit to fix an image passing through a conveying path 20. The unfixed toner image on the recording material P is fixed on the recording material surface as a fixed image by receiving heat from a heat roller 21*a* and pressure from a pressure roller 21*b* which are arranged at the fixing device 21.

In the above image forming apparatus, an image forming unit includes an image processing device to perform a predetermined image processing on input image information and an exposure unit to form a latent image by exposing the surface of an evenly charged image bearing member based on image data processed by the image processing device. Further, the image forming unit includes a development unit to visualize a latent image with toner having a potential by applying a predetermined development bias, and a transfer unit to transfer a toner image from the surface of the image bearing member to a recording medium via an intermediate transfer member or directly thereto. Here, the image processing device denotes an entire portion to perform the image processing including the image processing portion 35 and the controller B. The image processing portion 35 is a processing portion to convert a light image read by a reader to an image signal. The image processing portion 35 is not utilized when an image signal is directly input from an external host device.

A normal single fixing output mode, a partial gloss-up processing mode, a partial gloss-down processing mode and a duplex mode may be set as an image output mode. The normal single fixing output mode is an image forming operation mode to output an image-formed product with a single image forming and fixing operation on a recording material. The partial gloss-up processing mode is an image forming operation mode to output an image-formed product having a partially gloss-upped final output image formed by performing the first image forming and fixing operation and the second image forming and fixing on a single recording material. The partial gloss-down processing mode is an image forming operation mode to output an image-formed product having a partially gloss-downed final output image formed by performing the first image forming and fixing operation and the second image forming and fixing operation on a single recording material. The duplex mode is an image forming operation mode to output an image-formed product having an image formed respectively on both the front and back faces of a recording material.

Figure 2A:
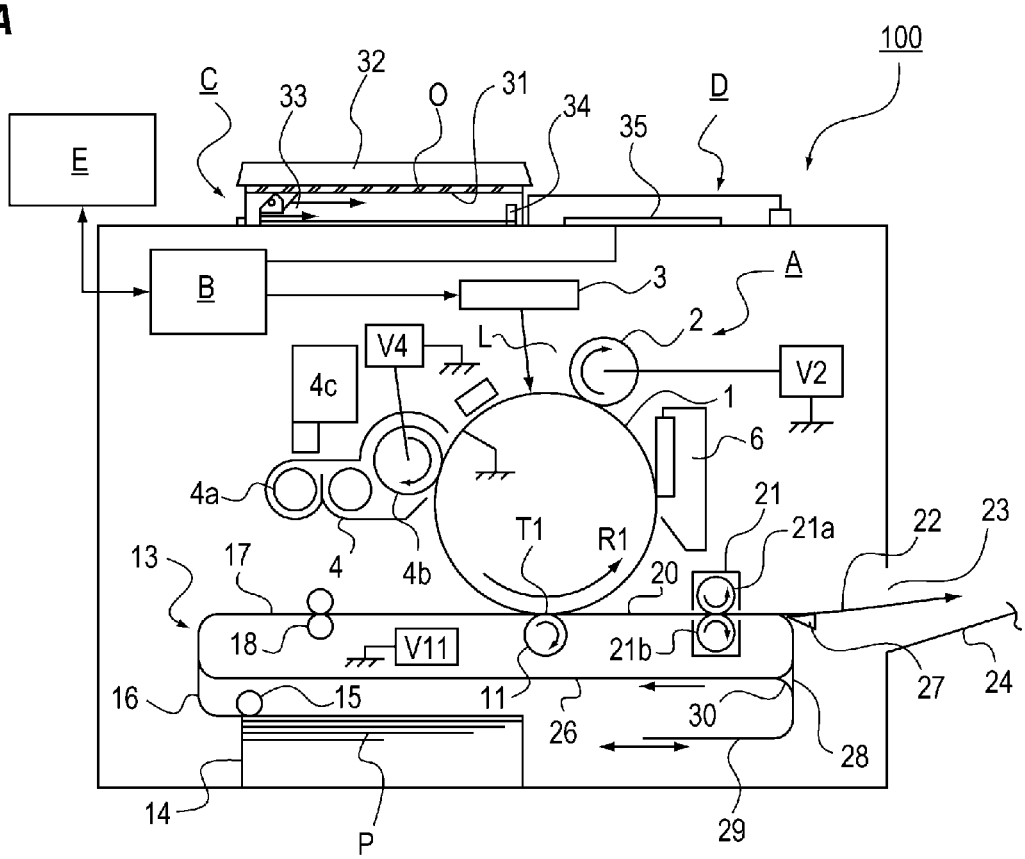
FIG. 2A is a schematic sectional view of an image forming apparatus having another configuration.

In the case of the normal single fixing output mode, the recording material P discharged from the fixing device 21 after receiving image forming and fixing once is discharged as an image-formed product onto a discharge tray 24 from a discharge port 23 via a conveying path 22. In the case of the partial gloss-down processing mode or the partial gloss-up processing mode, the recording material discharged from the fixing device 21 after receiving the first image forming and fixing is guided to a re-conveying path 26 via a conveying path 25 after having the proceeding route thereof changed by a flapper 27. That is, the recording material having the first output image formed with the image output process to perform the first image forming process and the first fixing process is guided to the re-conveying path 26 to receive the second image output process to perform the second image forming process and the second fixing process. The recording material P guided to the re-conveying path 26 is re-entered into the conveying path 17 having the registration roller 18, and then, is conveyed to the nip portion T2 in synchronization with arriving of a toner image on the belt 7 to the nip portion T2. Then, the toner image on the belt 7 for the second image forming process is sequentially transferred to the surface of the recording material P. The recording material P, having passed through the nip portion T2, is detached from the belt 7 and is guided to the fixing device 21 through the conveying path 20 to receive the second fixing process. That is, the second output image is formed, by the second image output process to perform the second image forming process and the second fixing process, on the image face of the recording material having the first output image formed by the first image output process. Accordingly, the final output image, which is the product of the partial gloss-down process or the partial gloss-up process, is formed on the recording material. The recording material is discharged as a partially gloss-down processed image-formed product or a partially gloss-up processed image-formed product onto the discharge tray 24 from the discharge port 23 via the conveying path 22 after being discharged from the fixing device 21. The abovementioned partial gloss-down processing mode and partial gloss-up processing mode will be described below in detail. In the case of the duplex mode, the recording material P having an image formed on one face thereof discharged from the fixing device 21 is guided to a switch-back conveying path 29 through a conveying path 28 after having the proceeding route thereof changed by the flapper 27. Then, the recording material P is guided to the re-conveying path 26 through a conveying path 30 in a reversed state of front and back faces by being conveyed with the switch-back operation. The recording material P guided to the re-conveying path 26 re-enters the conveying path having the registration roller 18, and then, is conveyed to the nip portion T2 in synchronization with arriving of a toner image on the belt 7 to the nip portion T2. Then, the toner image on the belt 7 for the second image forming process is sequentially transferred to the other surface of the recording material P. The recording material P having passed through the nip portion T2, is detached from the belt 7 and is guided to the fixing device 21 through the conveying path 20 to receive the second fixing process. Accordingly, image forming operation is performed on both front and back faces of the recording material. The recording material is discharged as a duplex image-formed product onto the discharge tray 24 from the discharge port 23 through the conveying path 22 after being discharged from the fixing device 21. Here, in the image forming apparatus, the transferring of the toner image formed on the drum 1 to the recording material P may be performed directly by a transfer portion such as a primary transfer roller 11 or a transfer belt as illustrated in FIG. 2A without utilizing the intermediate transfer member 7.

(2) Operation Portion D

Figure 2B:
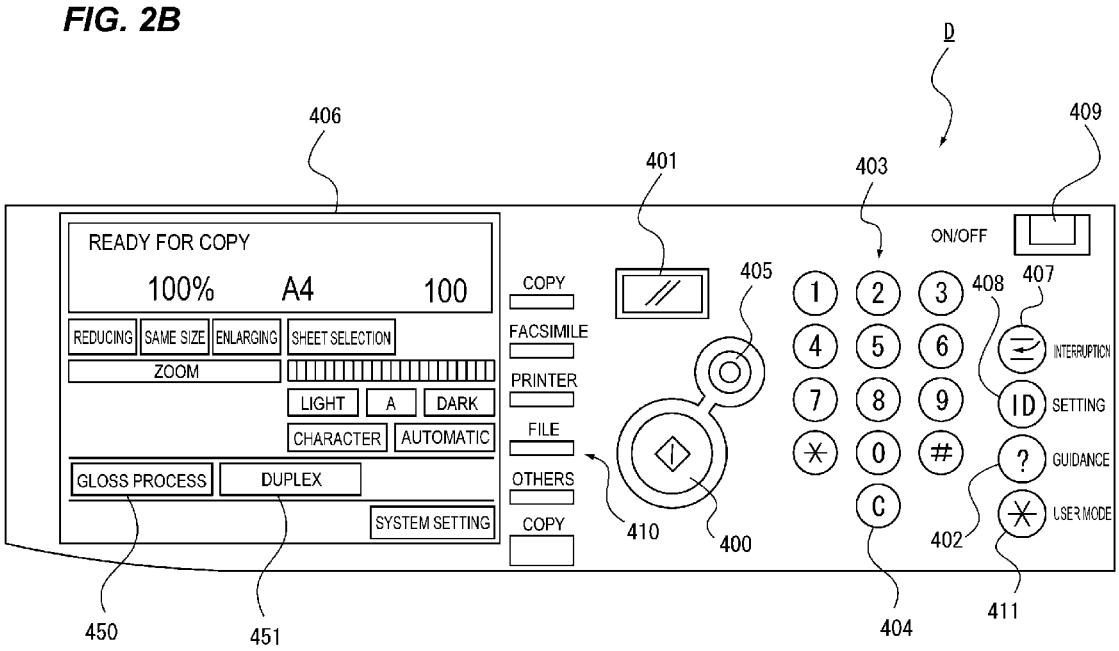
FIG. 2B is a plan view of an operation portion.

FIG. 2B is a plan view of the operation portion D. A copy start key (i.e., button) 400 instructs the apparatus to start copying. A reset key 401 is for returning the apparatus to a normal mode. A guidance key 402 is to be pressed when using a guidance function. A ten-key 403 is for inputting numerical values such as a set sheet number. A clear key 404 clears numerical values. A stop key 405 stops copying during continuous copying. A liquid crystal display portion and touch panel 406 displays setting of various modes and printer states. An interrupt key 407 is for performing an urgent copying to interrupt continuous copying or operating as a facsimile machine or a printer. An ID key 408 is for managing the copy number for each person or department. A soft switch 409 performs ON/OFF operation of the power source of the image forming apparatus main body. A function key 410 is used for changing functions of the image forming apparatus. A user-mode key 411 is for entering into a user mode to previously set items for a user, such as turning ON/OFF an automatic cassette or changing the set time for entering an energy-saving mode. In addition, a gloss processing mode (i.e., gloss-up or gloss-down) selection key 450 and a duplex image forming mode selection key 451 are arranged.

Figure 2C:
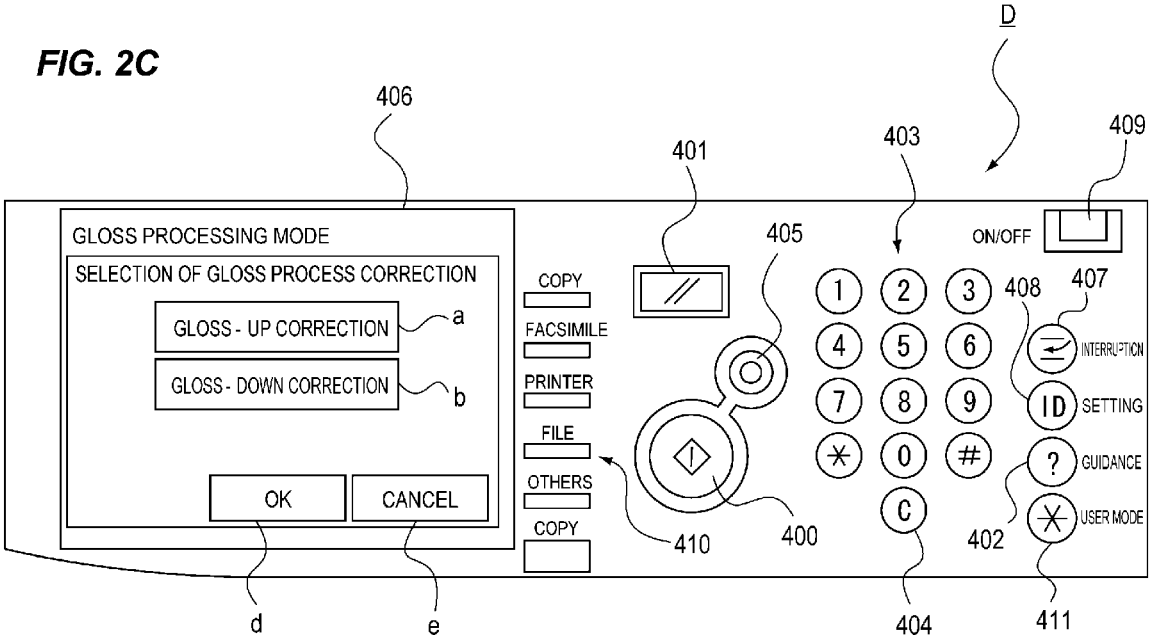
FIG. 2C is a plan view of the operation portion in a state that a gloss processing mode selection screen is displayed at a display portion.

In the copy mode to copy an original, when an image-formed product of which gloss is partially heightened or lowered is to be output, desired copying conditions are set at the operation portion D, and then, the gloss processing mode selection key 450 is selected. Then, as illustrated in FIG. 2C, the liquid crystal display portion 406 displays a gloss-up correction mode key a, a gloss-down correction mode key b, an OK key d and a cancel key e as a touch panel. The gloss-up correction mode key a for selecting the partial gloss-up processing mode is used in the case that the gloss of an area selected by a user is desired to be heightened from that of the other areas in an image to be output. The gloss-down correction mode key b for selecting the partial gloss-down processing mode is used in the case that the gloss of an area selected by a user is desired to be lowered from that of the other areas in an image to be output.

(3) Gloss Processing Mode (3-1) Next, a gloss processing mode (i.e., a gloss processing output mode) as a feature of the present embodiment will be described in detail. First, a description is provided on the image data quantity. The image data quantity used in the description of the present invention is defined as the data quantity per pixel in image information of an image to be an original. The maximum image data quantity is expressed as 100%. Toner quantity for image forming is calculated corresponding to the image data quantity of 0% to 100%. The toner quantity is defined as the quantity of toner per pixel of an image formed on a recording material. Similarly to the image data quantity, the toner quantity is expressed as 0% to 100%. The toner weight of image forming in 1 $cm^2$ is called the mount quantity. The toner quantity of 100% in a single color brings the maximum density of the color. Having the maximum density as a reference, main body process conditions such as development conditions are determined corresponding to the toner quantity of 0% to 100% so that the image density is linearly from 0% to 100%. The maximum density is influenced by toner characteristics, the fixing conditions of the fixing device 21 and the types of the recording material P and is varied depending on the image design as to how dark the maximum density is set. In the present embodiment, the process speed is set at 200 mm/s. Further, the controlled temperature (i.e., the fixing temperature) of the fixing device 21 of the present embodiment is set at 160° C. The temperature is kept the same in both the first and second fixing processes of performing the partial gloss-up processing mode or the partial gloss-down processing mode. With the above conditions, the density of 1.5 was obtained with a toner mount quantity of 0.5 mg/cm$^2$ when using plain paper (of which paper gloss is approximate 6%) having a basis weight of 80 g/m$^2$ as the recording material P. The toner mount quantity of 0.5 mg/cm$^2$ is set to the maximum mount quantity.

(3-2) In the copy mode, a difference in partial gloss of an original image cannot be read with the scanner C. Accordingly, a glossiness area assigning unit performs an operation to input, to the controller B, area information (i.e., a pattern and coordinates of a gloss mark generation area) of an image part desired to be output with gloss upped or downed from circumferential image parts in the original image. For example, the image part desired to be output with gloss upped or downed from circumferential image parts in the original image is previously output with a monochrome binary image as a gloss assignment image (i.e., an assigned previously output image with a monochrome binary image as a gloss assignment image (i.e., an assigned image part)). That is, an original image for gloss correction area assignment prepared as a monochrome image is previously output. The original for gloss correction area assignment (i.e., a gloss original) is scanned by a scanner C after the operation mode of the apparatus 100 is set to a mode to read the image being acknowledged as a gloss assignment image. With the above process, area information of an image part desired to be output with gloss upped or downed in the original image to be copied is input to the controller B. Here, the gloss assignment image is appropriately determined as being divided into categories to be distinguished and assigned as an object such as character information or to be distinguished and assigned as an area.

Figure 3A:
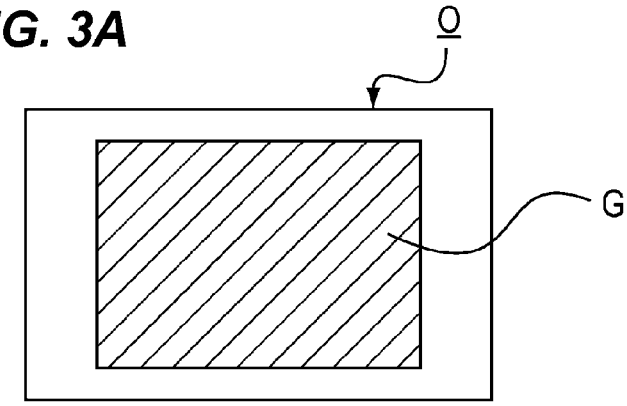
FIGS. 3A to 3E are schematic views for describing a partial gloss-up processing mode and a partial gloss-down processing mode.
Figure 3B:
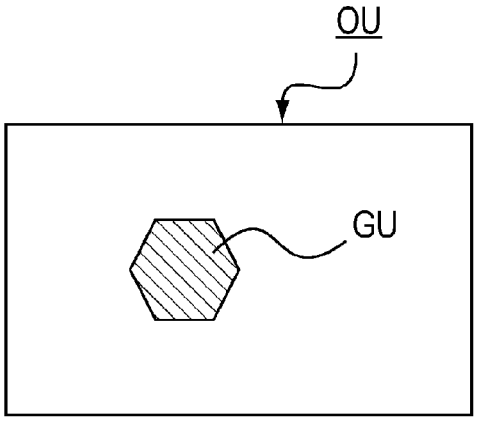
Figure 3C:
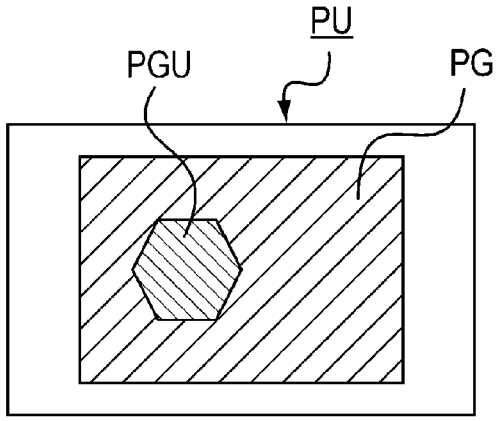
Figure 3D:
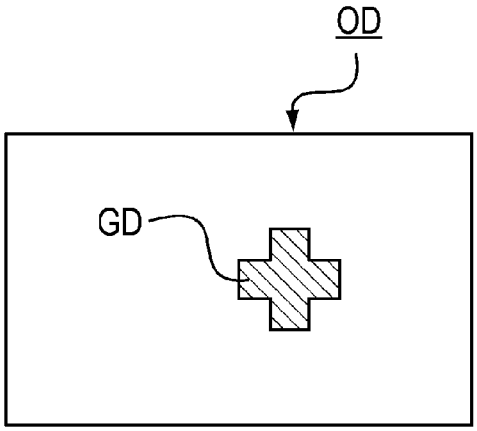
Figure 3E:
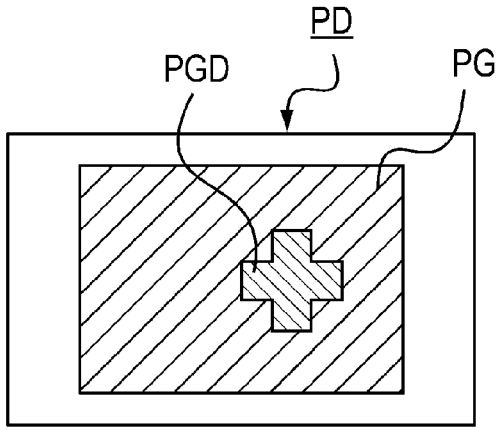
Figure 4A:
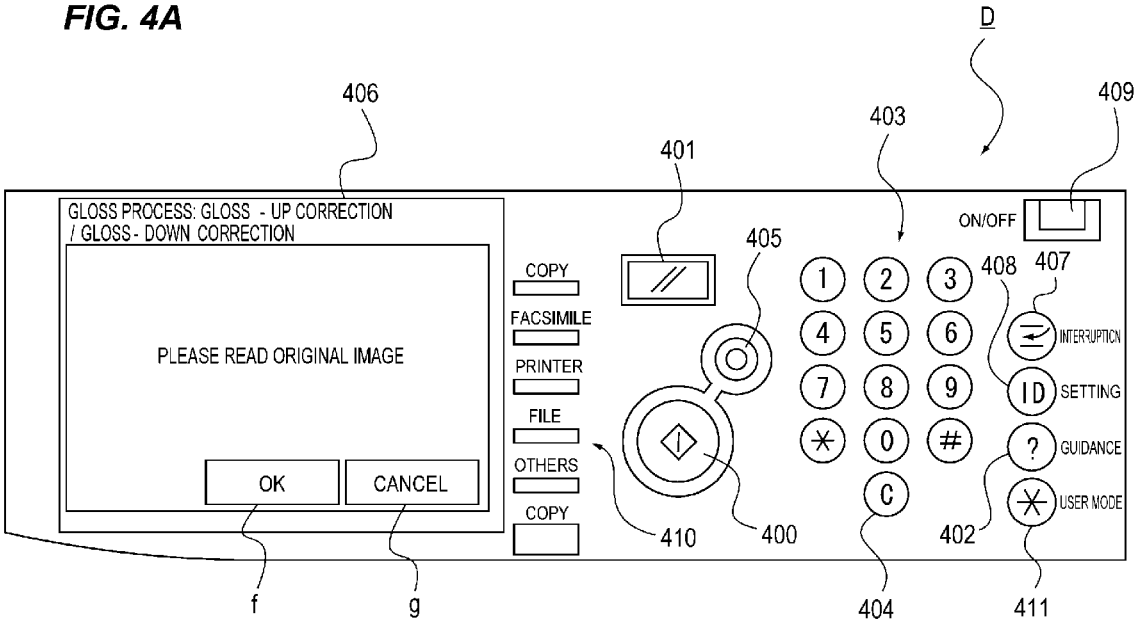
FIG. 4A is a plan view of the operation portion in a state that a screen for instructing to read an original image is displayed at the display portion.
Figure 4B:
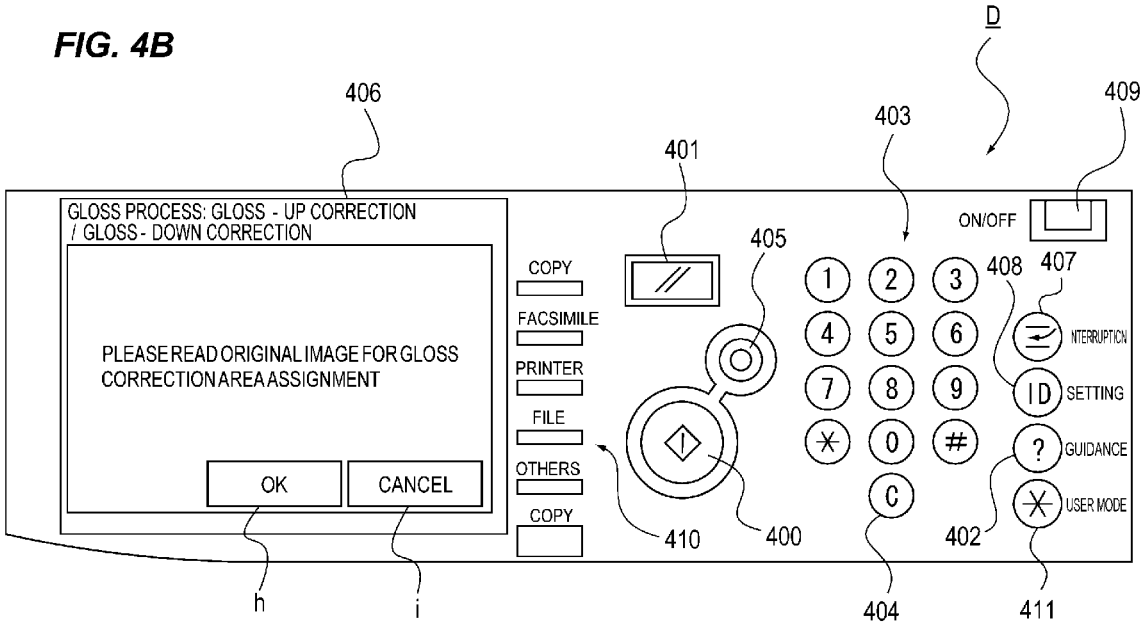
FIG. 4B is a plan view of the operation portion in a state that a screen for instructing to read an original image for gloss correction assignment is displayed at the display portion.

As described above, when the gloss processing mode selection key 450 is selected in the copy mode, the crystal liquid display portion 406 displays "Gloss-up correction" and "Gloss-down correction" as illustrated in FIG. 2C. After performing selection of gloss-up or gloss-down, the scanner C performs an operation to sequentially read the original image to be copied and the original image for gloss correction area assignment. For convenience, O denotes an original to be copied and G denotes an image of the original in a schematic view of FIG. 3A. In a schematic view of FIG. 3B, OU denotes a gloss-up assignment original and GU denotes a gloss-up assignment image part thereof. In a schematic view of FIG. 3D, OD denotes a gloss-down assignment original and GD denotes a gloss-down assignment image part thereof. The gloss-up correction mode key a or the gloss-down correction mode key b is selected and the OK key d is pressed in the screen of the gloss processing mode of FIG. 2C. Accordingly, the liquid crystal display portion 406 displays a screen to instruct the apparatus to read the original image to be copied, as illustrated in FIG. 4A. Then, the original O to be copied is set at the scanner C and the OK key f is pressed. Accordingly, reading of the image information of the original O is performed and the image data processed by the image processing device 35 is input to the controller B as original image information. When reading of the original image information is completed by the scanner C, the liquid crystal display portion 406 displays a screen to instruct the apparatus to read the original image for gloss correction area assignment, as illustrated in FIG. 4B. Then, the gloss-up assignment original OU or the gloss-down assignment original OD is set at the scanner C and the OK key h is pressed. Accordingly, reading of image information of the original OU or the original OD is performed and the image data processed by the image processing device 35 is input to the controller B as gloss assignment image information. With the operation as described above, the controller B receives the original image information and the gloss information and performs the partial gloss-up processing mode or the partial gloss-down processing mode, which will be described below. FIG. 3C is a schematic view of an image-formed product PU output by performing the partial gloss-up processing mode based on the image information of the original O of FIG. 3A and the gloss-up assignment image information (i.e., the gloss information) of the gloss-up assignment original OU of FIG. 3B. Here, PG denotes an image-formed part and PGU denotes a gloss-up part (i.e., a gloss mark part being a partially gloss-upped image part) of the image-formed part. FIG. 3E is a schematic view of an image-formed product PD output by performing the partial gloss-down processing mode based on the image information of the original O of FIG. 3A and the gloss-down assignment information (i.e., the gloss information) of the gloss-down assignment original OD of FIG. 3D. Here, PG denotes an image-formed part and PGD denotes a gloss-down part (i.e., a gloss mark part being a partially gloss-downed image part) of the image-formed part. The image forming apparatus may be configured to adopt a digitizer as the glossiness area assigning unit to assign area information of an image part desired to be output with gloss upped or downed from circumferential image parts in the original image.

In the print mode, an image desired to be output is prepared by utilizing image software capable of managing gloss information with a personal computer as the external host device E. Then, the prepared image data is converted into image information and gloss information at a raster image processor (RIP) portion. At that time, the software is to be capable of assigning whether the prepared gloss assignment area image is desired to be gloss-upped or gloss-downed. The image data converted into the image information and the gloss information is transmitted to the controller B after being converted into image information corresponding to an output device by a printer driver. The controller B performs the partial gloss-up processing mode or the partial gloss-down processing mode based on the input image information and the gloss information. Accordingly, as illustrated in the schematic view of FIG. 3C or FIG. 3E, the image-formed product PU or PD having the partially gloss-upped or gloss-downed image part PGU or PGD is output.

(3-3) Image Forming Process and Fixing Process when Gloss Processing Mode is Selected In a mode to perform a gloss process (i.e., gloss-up correction/gloss-down correction), the controller B performs the control described below based on the input image information and the gloss information as described above, so as to perform image forming and fixing. The controller B performs a determination for every pixel of the input image information to determine whether it is a pixel to have gloss control performed in the gloss information. That is, every pixel of the image information is determined to be a gloss control target pixel GM to have gloss control performed or a non-gloss control target pixel GN not to have gloss control performed. Different image forming processes are performed respectively thereon. Here, the gloss control target pixels GM constitute a pixel group having gloss-down or gloss-up assigned and form the assigned image part as an image part in an assigned area. The non-gloss control target pixels GN constitute a pixel group not having both gloss-down and gloss-up assigned and form the non-assigned image part, being other than the assigned image part. In either of the partial gloss-up processing mode and the partial gloss-down processing mode, the image forming and fixing on the recording material P are performed with the first and the second image output processes. The first image output process is a process to form the first output image with the first image forming process and the first fixing process on the recording material P. The second image output process is a process to form the second output image with the second image forming process and the second fixing process on a recording material having the first output image formed.

<1> Gloss-down Correction Mode

Figure 4C:
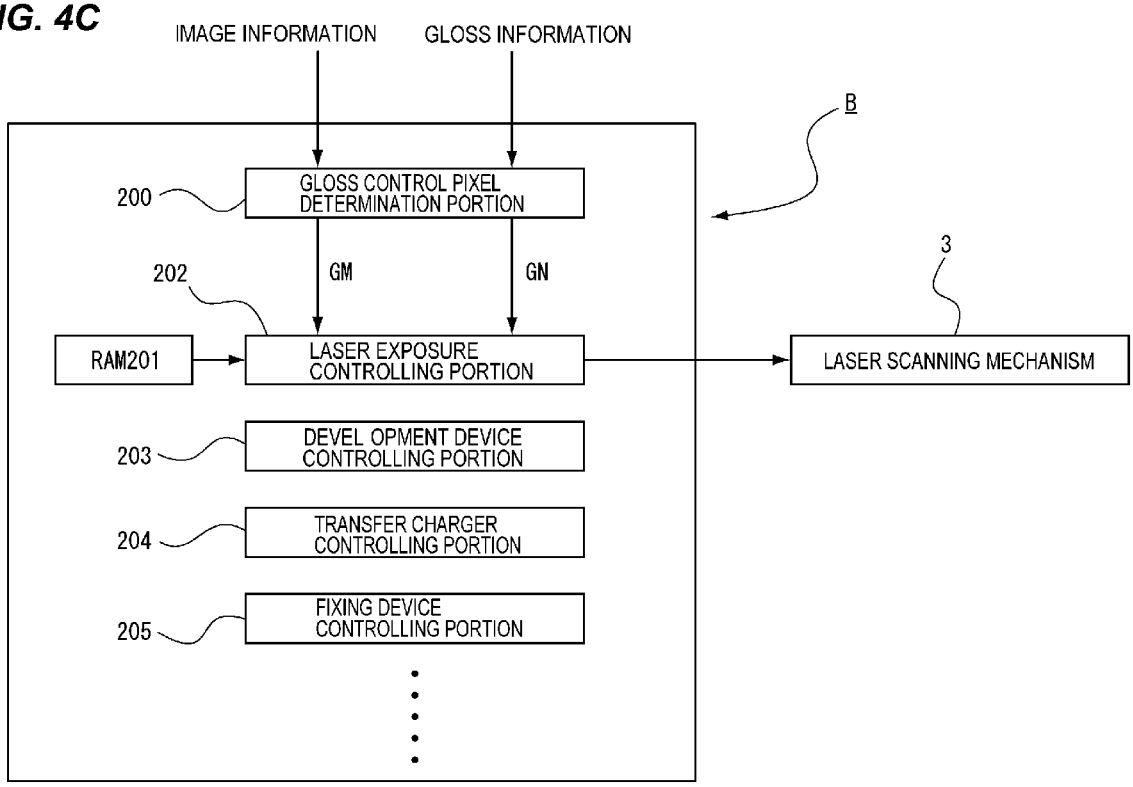
FIG. 4C is a detail view of a controller portion.

First, a description is provided of the case that the controller B gloss-downs the gloss control target pixel group GM based on the input image information and the gloss information. FIG. 4C is a detailed view of the controller B. In the copy mode or the print mode, the image information and the gloss information assigned by a user and respectively representing the image process to be performed are input to a gloss control pixel determination portion 200 in the controller B. In the determination portion 200, as described above, every pixel of the image information is determined to be classified into the gloss control target pixel group GM or the non-gloss control target pixel group GN not having gloss control performed and is transmitted to a laser exposure controlling portion 202. A RAM 201 stores input image information and a look-up table GMLUT(0) of laser exposure strength for the gloss control target pixels GM and input image information and a look-up table GNLUT(0) of laser exposure strength for the non-gloss control target pixels GN. The table GMLUT(0) includes two types of tables of a table GMLUT(0)_1 to be used in the first image forming process of the first image output process and a table GMLUT(0)_2 to be used in the second image forming process of the second image output process. The table GNLUT(0) includes two types of tables of a table GLUT(0)_1 to be used in the first image forming process of the first image output process and a table GNLUT(0)_2 to be used in the second image forming process of the second image output process. By utilizing the above tables, in the first image forming process, the controlling portion 202 controls the laser scanning mechanism 3 so as to form an image based on the table GMLUT(0)_1 for the gloss control target pixels GM and the table GLUT(0)_1 for the non-gloss control target pixels GN. Similarly, in the second image forming process, the controlling portion 202 controls the laser scanning mechanism 3 so as to form an image based on the table GMLUT(0)_2 for the gloss control target pixels GM and the table GNLUT(0)_2 for the non-gloss control target pixels GN.

Figure 5A:
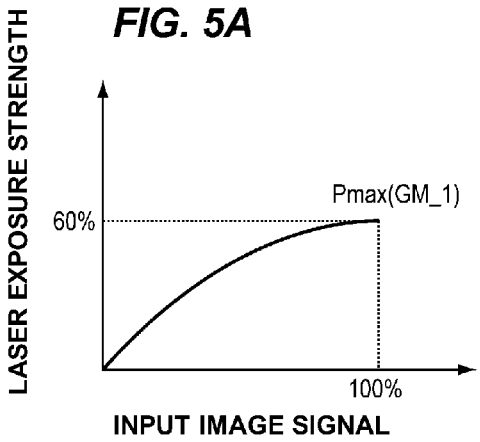
FIGS. 5A to 5D are views which illustrate look-up tables of a gloss-down correction mode in the first embodiment.
Figure 5B:
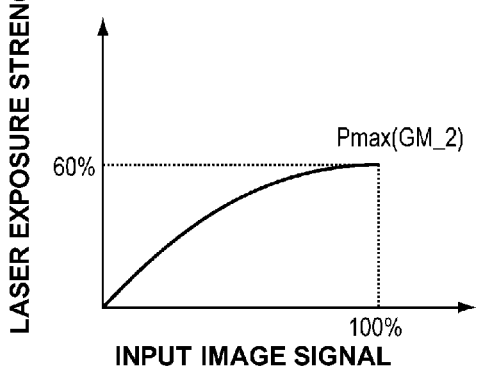
Figure 5C:
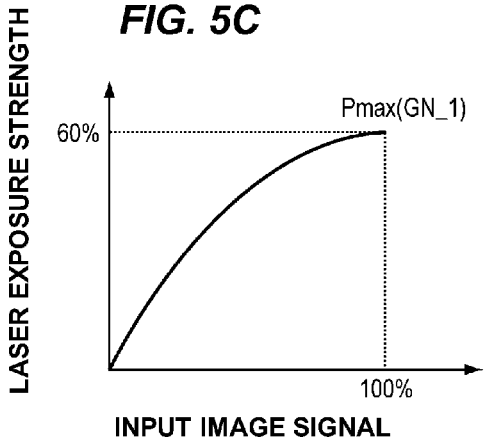
Figure 5D:
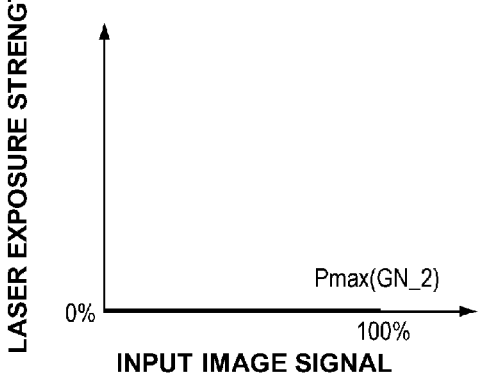
Figure 6A:
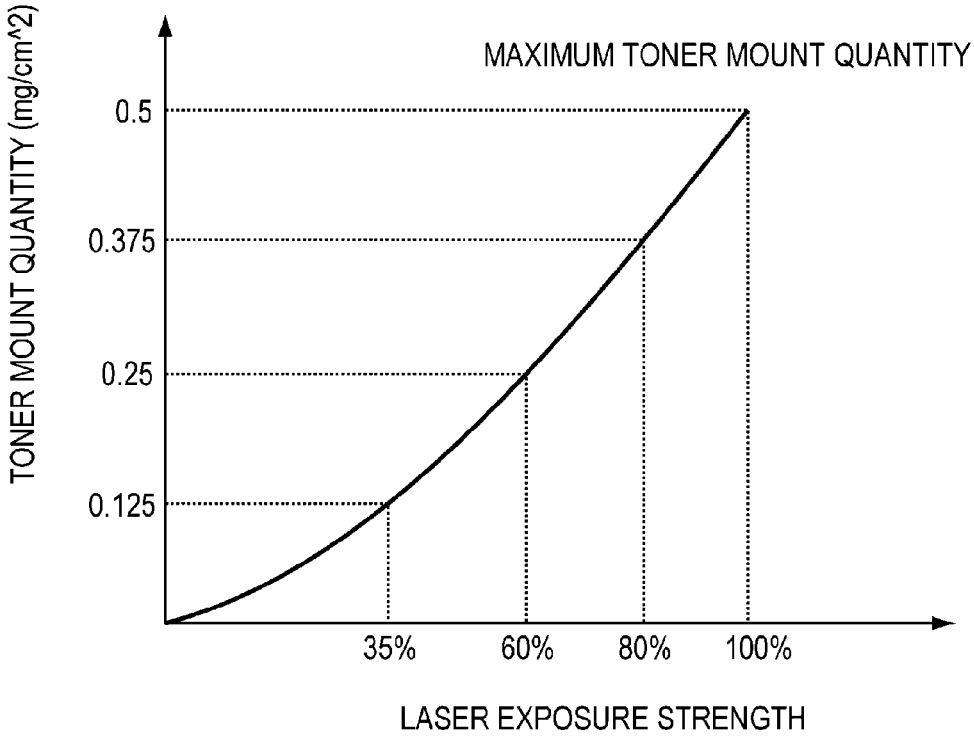
FIG. 6A is a view which illustrates a correlation between the laser exposure strength and the toner mount quantity on a recording material in the first embodiment.
Figure 6B:
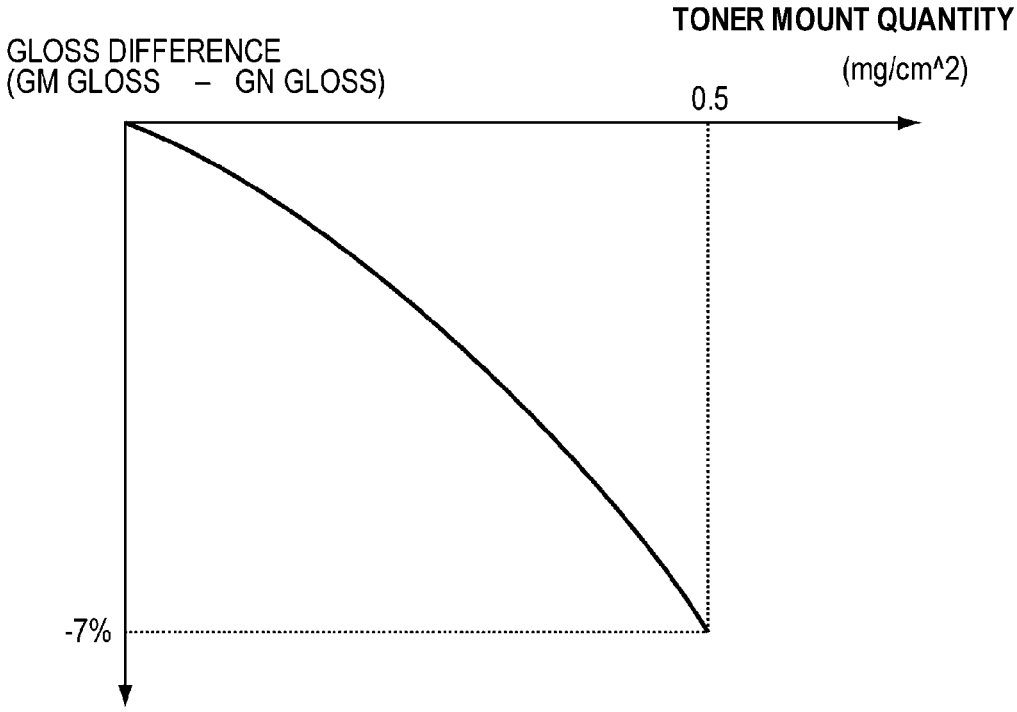
FIG. 6B is a view which illustrates a gloss-down range in the first embodiment.
Figure 7A:
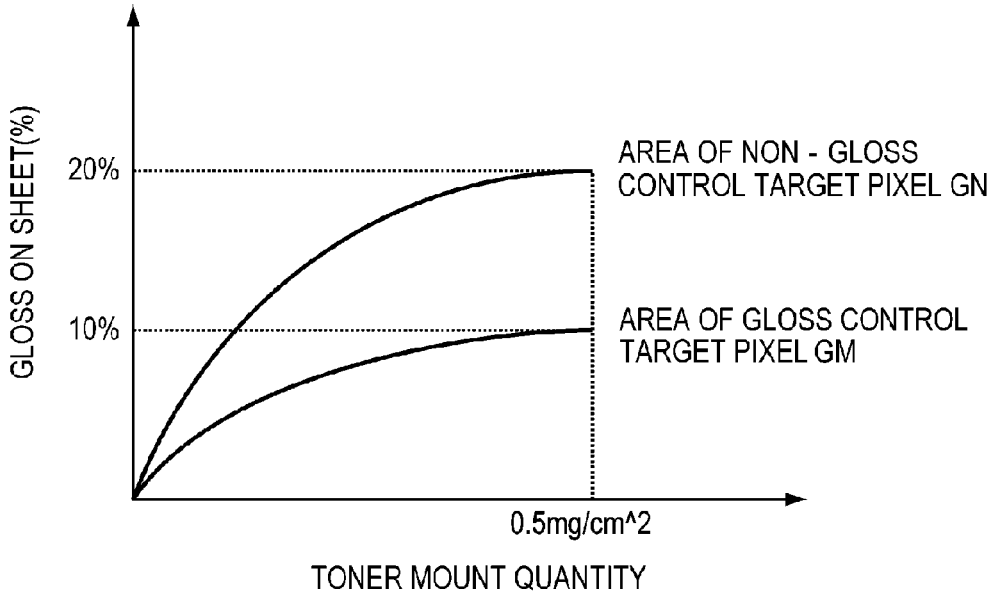
FIG. 7A is a view which indicates the absolute values of gloss in the first embodiment.

FIGS. 5A to 5D are views illustrating the tables of GMLUT(0)_1, GLUT(0)_1, GMLUT(0)_2 and GNLUT(0)_2 of the present embodiment. FIG. 5A illustrates GMLUT(0)_1, FIG. 5B illustrates GLUT(0)_1, FIG. 5C illustrates GMLUT(0)_2, and FIG. 5D illustrates GNLUT(0)_2. The above tables are determined based on correlation between the laser exposure strength and the toner mount quantity on a recording material (i.e., on a sheet) as illustrated in FIG. 6A. As described above, in the image forming apparatus according to the present embodiment, the toner mount quantity of 0.5 mg/cm$^2$ on a recording material obtained at the density of 1.5 is the maximum toner mount quantity. The laser exposure strength thereat is to be the 100% output. Accordingly, at the gloss control target pixels GM, image forming is performed in the first image forming process in the condition that a half toner quantity of 0.25 mg/cm$^2$ of the maximum toner mount quantity of 0.5 mg/cm$^2$ is to be the maximum toner mount quantity based on the table GMLUT(0)_1. Further, in the second image forming process after being fixed with the first fixing process, image forming is performed under the condition that the residual half toner quantity of 0.25 mg/cm$^2$ is to be the maximum toner mount quantity based on the table GMLUT(0)_2. Subsequently, the final output image is obtained with the second fixing process. Meanwhile, at the non-gloss control target pixels GN, image forming is performed in the first image forming process under the condition that the maximum toner mount quantity of 0.5 mg/cm$^2$ is to be the maximum toner mount quantity based on the table GLUT(0)_1. In the second image forming process after being fixed with the first fixing process, image forming with toner is not performed, that is, so-called blank image forming is performed, based on the table GNLUT(0)_2. Subsequently, the final output image is obtained with the second fixing process. As described above, at the gloss control target pixels GM, toner is mounted on a sheet as being divided into two image forming processes. Meanwhile, at the non-gloss control target pixels GN, all toner is mounted in the first image forming process. Accordingly, gloss of the gloss control target pixels GM is to be lower than that of the non-gloss control target pixels GN. That is, the final output image having low gloss only at the gloss-down correction area as the assigned area can be obtained. As a method of measurement gloss in the present embodiment, a handy type glossmeter (PG-1M) manufactured by NIPPON DENSHOKU INDUSTRIES CO., LTD. is used as being compliant with the specular glossiness measuring method of JIS Z 8741. FIG. 6B is a graph indicating a gloss difference between the gloss-down correction area constituted with the gloss control target pixels GM and another area constituted with non-gloss control target pixels GN where gloss correction is not performed. The horizontal axis indicates the toner mount quantity on a sheet of the final output image. The vertical axis indicates the difference in gloss of the gloss control target pixels GM against the non-gloss control target pixels GN. As can be seen, the gloss of the gloss control target pixels GM having the gloss-down correction assigned thereto is lowered by approximate 7% at the toner quantity of 0.5 mg/cm$^2$ against the gloss of the non-gloss control target pixels GN being the other image area. Absolute values of gloss at that time at the area of the gloss control target pixels GM and at the area of the non-gloss control target pixels GN are indicated in FIG. 7A.

Figure 7B:
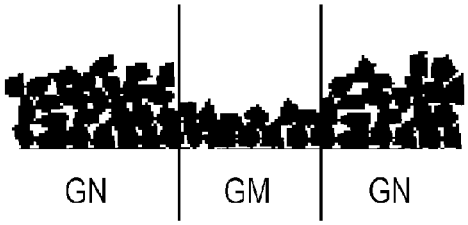
FIGS. 7B to 7E are schematic views for describing the reason why gloss-down can be performed in the first embodiment.
Figure 7C:
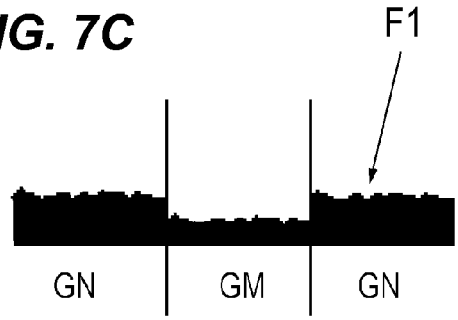
Figure 7D:
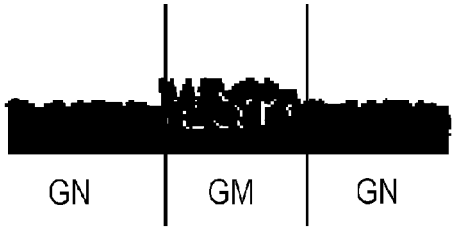
Figure 7E:
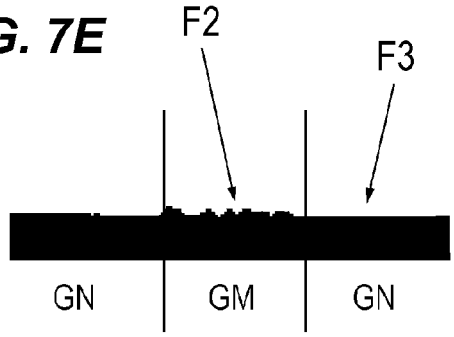

Here, a brief description is provided on the reason why gloss-down can be actualized by dividing the image forming process on the area where gloss-down correction is required as described above. FIGS. 7B to 7E are schematic views illustrating states of toner mounted on a recording material at the area of the gloss control target pixels GM and at the area of the non-gloss control target pixels GN in the gloss-down correction mode. FIG. 7B illustrates a state of toner after the first image forming process. FIG. 7C illustrates a state of toner after the first fixing process. FIG. 7D illustrates a state of toner after the second image forming process. FIG. 7E illustrates a state of toner after the second fixing process. FIG. 7B illustrates a state after the first image forming operation is performed, that is, unfixed toner of 0.25 mg/cm$^2$ is mounted on the area of the gloss control target pixels GM and unfixed toner of 0.5 mg/cm$^2$ is mounted on the area of the non-gloss control target pixels GN. Thereafter, the toner is fixed with the first fixing process as illustrated in FIG. 7C. With the first fixing process, a toner layer mounted on the recording material is melted and fixed to the recording material. However, asperity remains at a surface layer part thereof (i.e., F1 part in FIG. 7C) due to toner shapes. Subsequently, the recording material is guided once again to the transfer nip portion T2 (see FIG. 1A) or T1 (see FIG. 2A) via the re-conveying path 26 in order to receive the second image forming operation FIG. 7D illustrates a state that unfixed toner of 0.25 mg/cm$^2$ is mounted in turn only on the area of the gloss control target pixels GM with the second image forming process. Further, the final output image is obtained as illustrated in FIG. 7E by performing the second fixing process thereafter. Here, a comparison is performed between a toner layer surface layer part F2 in the area of the gloss control target pixels GM and a toner layer surface layer part F3 in the area of the non-gloss control target pixels GN. Since the surface layer part F2 receives the fixing process only once, the surface layer part F2 has the surface layer shape being similar to that of the surface layer part F1 in FIG. 7C. However, since the fixing process is performed twice, the surface layer part F3 has a flat shape with little asperity. In this manner, gloss at the area of the gloss control target pixels GM can be lowered from that at the area of the non-gloss control target pixels GN. Accordingly, it is possible to obtain the final output image having lowered gloss at an assigned area in the gloss-down correction mode.

Figure 8A:
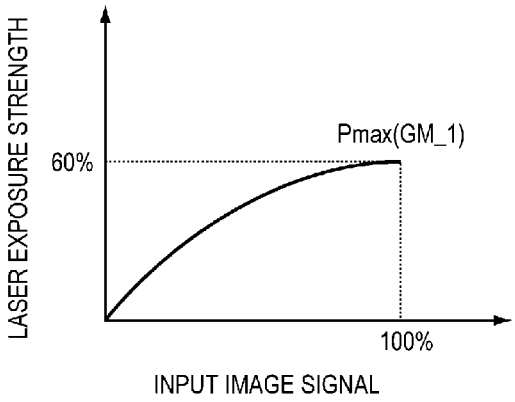
FIGS. 8A to 8D are views which illustrate look-up tables of the gloss-down correction mode in the first embodiment.
Figure 8B:
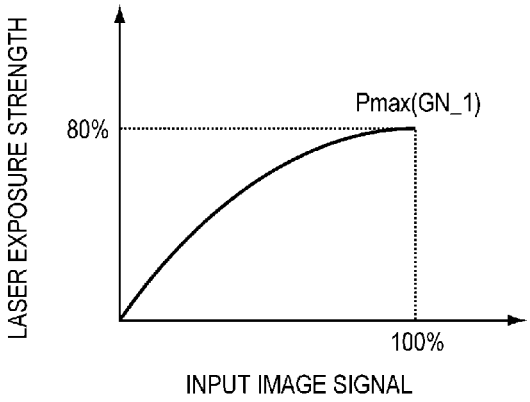
Figure 8C:
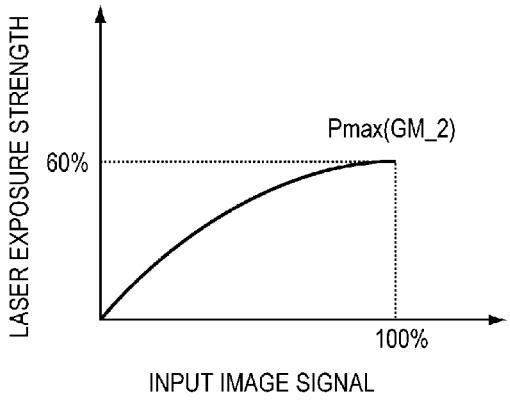
Figure 8D:
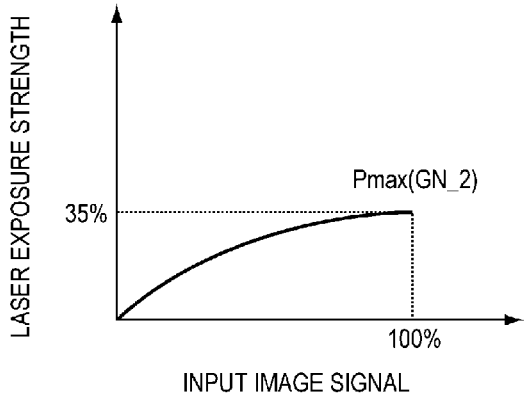

As described above, at the area of the non-gloss control target pixels GN, image forming is performed on the recording material with toner of 0.5 mg/cm$^2$ in the first image forming process. Then, in the second image forming process, image forming with toner of 0 mg/cm$^2$, that is, so-called blank image forming, is performed. However, at the area of the non-gloss control target pixels GN, it is also possible to perform image forming on a recording material by dividing the toner quantity for the first and second image forming processes as performed at the area of the gloss control target pixels GM. In this case, the toner quantity is required as follows. Here, the toner quantity for image forming onto the recording material in the first image forming process at the area of the non-gloss control target pixels GN is defined as N1 mg/cm$^2$. The toner quantity for image forming onto the recording material in the second image forming process is defined as N2 mg/cm$^2$. Further, the toner quantity for image forming onto the recording material in the first image forming process at the area of the gloss control target pixels GM is defined as M1 mg/cm$^2$. The toner quantity for image forming onto the recording material in the second image forming process is defined as M2 mg/cm$^2$. In this case, the ratio N2/N1 is required to be smaller than the ratio M2/M1. FIGS. 8A to 8D illustrate look-up tables in the case that the image forming processes are performed under the conditions that M1=0.25 mg/cm$^2$, M2=0.25 mg/cm$^2$, N1=0.375 mg/cm$^2$, and N2=0.125 mg/cm$^2$. FIG. 8A illustrates a table of GMLUT(4)_1, FIG. 8B illustrates a table of GNLUT(4)_1, FIG. 8C illustrates a table of GMLUT(4)_2, and FIG. 8D illustrates a table of GNLUT(4)_2.

The image forming apparatus to perform the gloss-down correction mode can be summarized as follows. The image forming apparatus forms an image in which the glossiness of an assigned image part that is an image part of an area assigned by a glossiness area assigning unit is lowered with respect to the glossiness of a non-assigned image part, being an image part other than the assigned image part. The image forming apparatus includes an image forming unit to form an unfixed toner image on a recording medium and a fixing unit to fix the toner image. The first image output process to form and fix an unfixed toner image on the recording medium is performed by the image forming unit and the fixing unit, as the toner quantity for the assigned image part is denoted as M1 and as the toner quantity for the non-assigned image part is denoted as N1. Further, the second image output process to form and fix an unfixed toner image on the recording medium having the first image output process performed is performed once again by the image forming unit and the fixing unit, as the toner quantity for the assigned image part is denoted as M2 and as toner quantity for the non-assigned image part is denoted as N2. Then, the cross relationship among the toner quantities is that M2/M1 is larger than N2/N1. Further, the image forming method to perform the gloss-down correction mode can be also summarized as follows. With the image forming method, an image in which the glossiness of an assigned image part that is an image part of an assigned area is lowered with respect to the glossiness of a non-assigned image part, being an image part other than the assigned image part, is formed on a recording medium. The method includes a first image output process to form and fix an unfixed toner image on the recording medium with a toner quantity for the assigned image part being denoted as M1 and with a toner quantity for the non-assigned image part being denoted as N1. The method includes a second image output process to form and fix an unfixed toner image once again on the recording medium, on which the first image output process has been performed with a toner quantity for the assigned image part being M2 and with a toner quantity for the non-assigned image part being denoted as N2. Then, the cross relationship among the toner quantities is that M2/M1 is larger than N2/N1. Accordingly, in the copy mode and print mode, an arbitrary area in an output image can be gloss-downed by controlling gloss without utilizing clear toner.

<2> Gloss-up Correction Mode

Figure 9A:
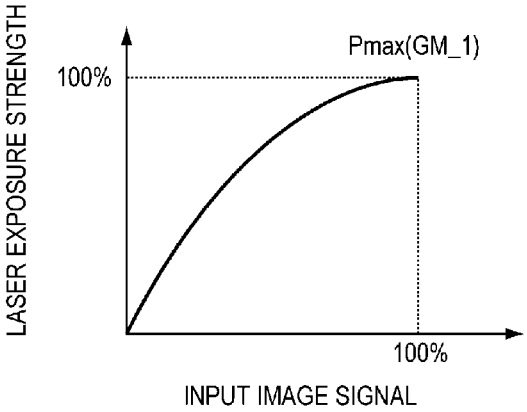
FIGS. 9A to 9D are views which illustrate look-up tables of the gloss-up correction mode in the first embodiment.
Figure 9B:
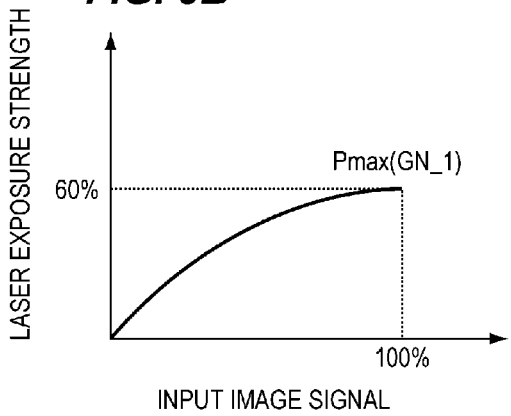
Figure 9C:
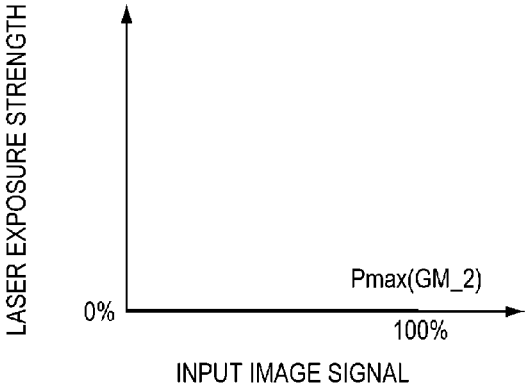
Figure 9D:
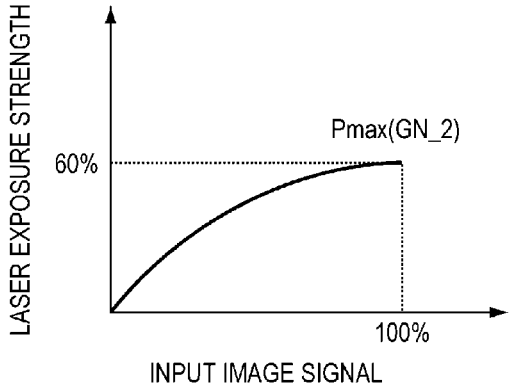

Next, a description is provided on the case that the gloss control target pixel group GM is gloss-upped based on the image information and the gloss information input to the controller B. Since the control outline thereof is similar to that of the gloss-down correction mode <1>, only different points will be described in the following discussion. The RAM201 stores input image information and a look-up table GMLUT (1) of laser exposure strength for the gloss control target pixels GM and input image information and a look-up table GNLUT(1) of laser exposure strength for the non-gloss control target pixels GN. The table GMLUT(1) includes two types of tables of a table GMLUT(1)_1 to be used in the first image forming process and a table GMLUT(1)_2 to be used in the second image forming process. The table GNLUT(1) includes two types of tables of a table GNLUT(1)_1 to be used in the first image forming process and a table GNLUT (1)_2 to be used in the second image forming process. FIGS. 9A to 9D are views illustrating the tables of GMLUT(1)_1, GNLUT(1)_1, GMLUT(1)_2 and GNLUT(1)_2 of the present embodiment. FIG. 9A illustrates GMLUT(1)_1, FIG. 9B illustrates GNLUT(1)_1, FIG. 9C illustrates GMLUT(1)_2, and FIG. 9D illustrates GNLUT(1)_2. According to FIGS. 9A to 9D and 6A, at the gloss control target pixels GM, image forming is performed in the first image forming process under the condition that the maximum toner mount quantity of 0.5 mg/cm$^2$ is to be the maximum toner mount quantity based on the table GMLUT(1)_1. In the second image forming process after being fixed with the first fixing process, image forming with toner is not performed, that is, a so-called blank image forming is performed, based on the table GMLUT(1)_2. Subsequently, the final output image is obtained with the second fixing process. Meanwhile, at the non-gloss control target pixels GN, image forming is performed in the first image forming process under the condition that a half toner quantity of 0.25 mg/cm$^2$ of the maximum toner mount quantity of 0.5 mg/cm$^2$ is to be the maximum toner mount quantity based on the table GNLUT(1)_1. Further, in the second image forming process after being fixed with the first fixing process, image forming is performed under the condition that the residual half toner quantity of 0.25 mg/cm$^2$ is to be the maximum toner mount quantity based on the table GNLUT(1)_2. Subsequently, the final output image is obtained with the second fixing process. As described above, at the gloss control target pixels GM, all toner is mounted in the first image forming process. Meanwhile, at the non-gloss control target pixels GN, toner is mounted on a recording material by being divided into two image forming processes. Accordingly, gloss of the gloss control target pixels GM is to be higher than that of the non-gloss control target pixels GN. That is, the final output image having high gloss only at the gloss-up correction area as the assigned area can be obtained.

Figure 10A:
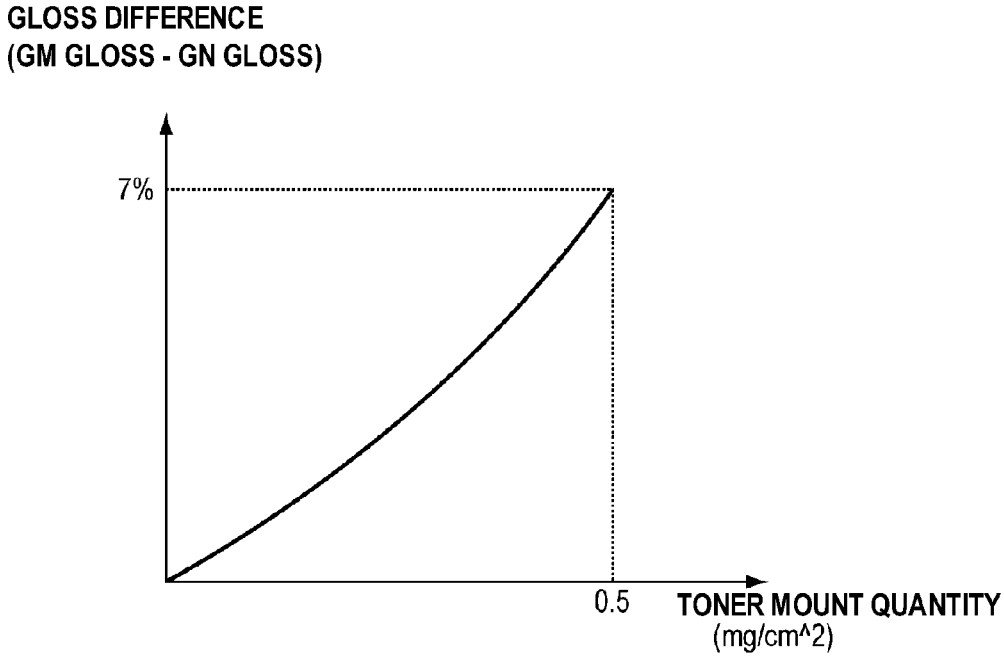
FIG. 10A is a view which illustrates a gloss-up range in the first embodiment.
Figure 10B:
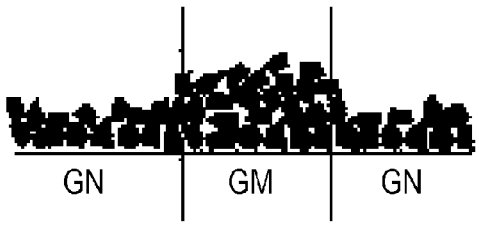
FIGS. 10B to 10E are schematic views for describing the reason why gloss-up can be performed in the first embodiment.
Figure 10C:
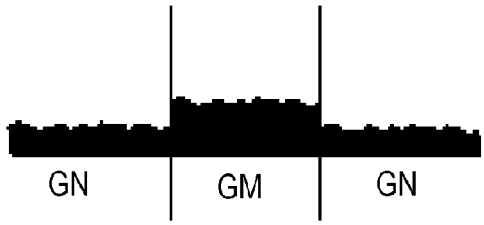
Figure 10D:
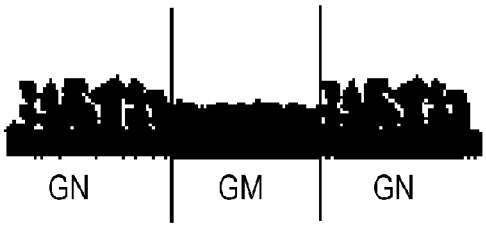
Figure 10E:
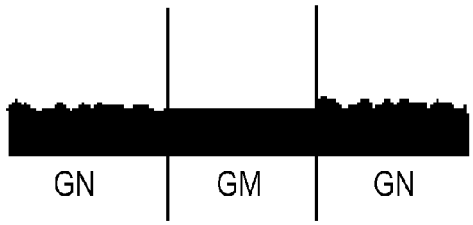

FIG. 10A is a graph indicating the gloss difference between the gloss-up correction area constituted with the gloss control target pixels GM and another area constituted with non-gloss control target pixels GN where gloss correction is not performed. As can be seen, the gloss of the gloss control target pixels GM having the gloss-up correction assigned thereto is heightened by approximate 7% at the toner quantity of 0.5 mg/cm$^2$ against the gloss of the non-gloss control target pixels GN being the other image area. Here, a brief description is provided on the reason why gloss-up can be actualized by dividing the image forming process on the area other than the area where gloss-up correction is required as described above. FIGS. 10B to 10E are schematic views illustrating the states of toner mounted on a recording material at the area of the gloss control target pixels GM and at the area of the non-gloss control target pixels GN in the gloss-up correction mode. FIG. 10B illustrates a state of toner after the first image forming process. FIG. 10C illustrates a state of toner after the first fixing process. FIG. 10D illustrates a state of toner after the second image forming process. FIG. 10E illustrates a state of toner after the second fixing process. As can be seen, the toner surface layer part in the area of the gloss control target pixels GM receiving the fixing process twice is shaped to be flatter with little asperity than the toner surface layer part in the area of the non-gloss control target pixels GN receiving the fixing process only once. In this manner, gloss at the area of the gloss control target pixels GM can be heightened from that at the area of the non-gloss control target pixels GN. Accordingly, it is possible to obtain the final output image having heightened gloss at an assigned area in the gloss-up correction mode.

Figure 11A:
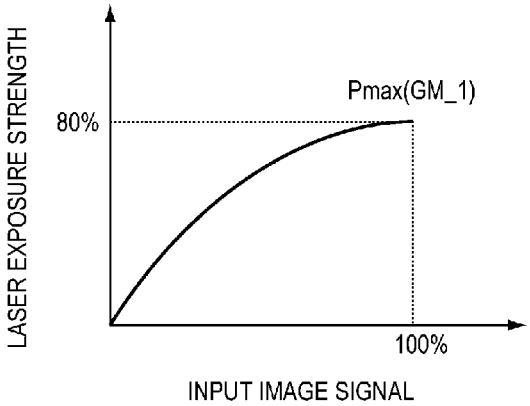
FIGS. 11A to 11D are views which illustrate look-up tables of the gloss-up correction mode in the first embodiment.
Figure 11B:
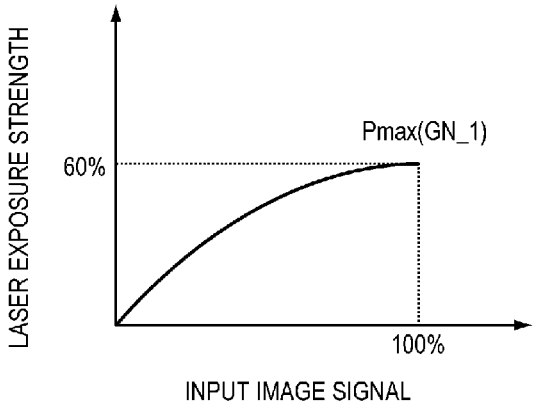
Figure 11C:
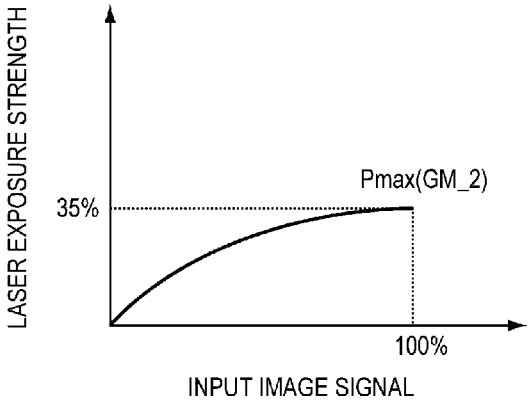
Figure 11D:
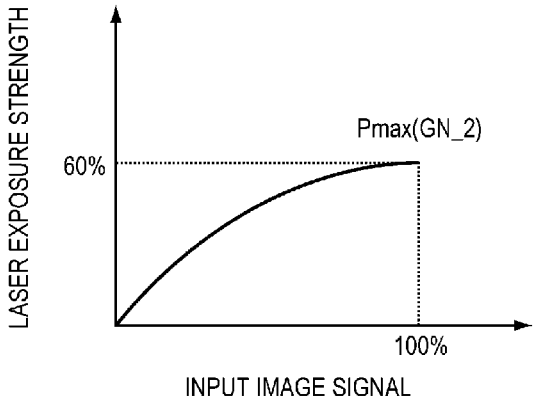

As described above, at the area of the gloss control target pixels GM, image forming is performed on the recording material with toner of 0.5 mg/cm$^2$ in the first image forming process. Then, in the second image forming process, image forming with toner of 0 mg/cm$^2$, that is, the so-called blank image forming, is performed. However, at the area of the gloss control target pixels GM, it is also possible to perform image forming on a recording material by dividing the toner quantity for the first and second image forming processes as performed at the area of the non-gloss control target pixels GN. In this case, toner quantity is required as follows. Here, the toner quantity for image forming onto the recording material in the first image forming process at the area of the gloss control target pixels GM is defined as M3 mg/cm$^2$. The toner quantity for image forming onto the recording material in the second image forming process is defined as M4 mg/cm$^2$. Further, the toner quantity for image forming onto the recording material in the first image forming process at the area of the non-gloss control target pixels GN is defined as N3 mg/cm$^2$. The toner quantity for image forming onto the recording material in the second image forming process is defined as N4 mg/cm$^2$. In this case, the ratio M4/M3 is required to be smaller than the ratio N4/N3. FIGS. 11A to 11D illustrate look-up tables in the case that the image forming processes are performed under the conditions that M3=0.375 mg/cm$^2$, M4=0.125 mg/cm$^2$, N3=0.25 mg/cm$^2$, and N4=0.25 mg/cm$^2$. FIG. 11A illustrates a table of GMLUT(5)_1, FIG. 11B illustrates a table of GNLUT(5)_1, FIG. 11C illustrates a table of GMLUT(5)_2, and FIG. 11D illustrates a table of GNLUT(5)_2. The above tables are determined based on correlation between the laser exposure strength and the toner mount quantity on a sheet as illustrated in FIG. 6A.

The image forming apparatus to perform the gloss-up correction mode can be summarized as follows. The image forming apparatus forms an image in which the gloss of an assigned image part being an image part of an area assigned by a glossiness area assigning unit is heightened with respect to the gloss of a non-assigned image part being an image part other than the assigned image part. The image forming apparatus includes an image forming unit to form an unfixed toner image on a recording medium and a fixing unit to fix the toner image. The first image output process to form and fix an unfixed toner image on the recording medium is performed by the image forming unit and the fixing unit with the toner quantity for the assigned image part being denoted by M3 and with the toner quantity for the non-assigned image part being denoted by N3. Further, the second image output process to form and fix an unfixed toner image on the recording medium having the first image output process performed is performed once again by the image forming unit and the fixing unit with the toner quantity for the assigned image part being denoted by M4 and as toner quantity for the non-assigned image part being denoted by N4. Then, the cross relationship among the toner quantities is that M4/M3 is smaller than N4/N3. Further, the image forming apparatus to perform the gloss-up correction mode can be also summarized as follows. With the image forming method, an image is formed on a recording medium in which the gloss of an assigned image part, being an image part of an assigned area, is heightened with respect to the gloss of a non-assigned image part being an image part other than the assigned image. The method includes the first image output process to form and fix an unfixed toner image on the recording medium with the toner quantity for the assigned image part being denoted by M3 and with toner quantity for the non-assigned image part being denoted by N3. The method includes the second image output process to form and fix an unfixed toner image once again on the recording medium having the first image output process performed with the toner quantity for the assigned image part being denoted by M4 and with the toner quantity for the non-assigned image part being denoted by N4. Then, the cross relationship among the toner quantities is that M4/M3 is smaller than N4/N3. Accordingly, in the copy mode and print mode, an arbitrary area in an output image can be gloss-upped by controlling gloss without utilizing clear toner.

[Second Embodiment]

Since the present embodiment has the approximately same image forming operation and apparatus main body configuration as the first embodiment, only different points will be described in the following discussion. In the gloss-up correction mode and the gloss-down correction mode of the present embodiment, a correction level can be designated, and then, image forming conditions are changed corresponding to the level. That is, a gloss designation unit capable of designating the glossiness level of an assigned image part is provided and image forming conditions in the first image output process and image forming conditions in the second output process regarding the assigned image part are changed corresponding to the designated glossiness level.

Figure 12A:
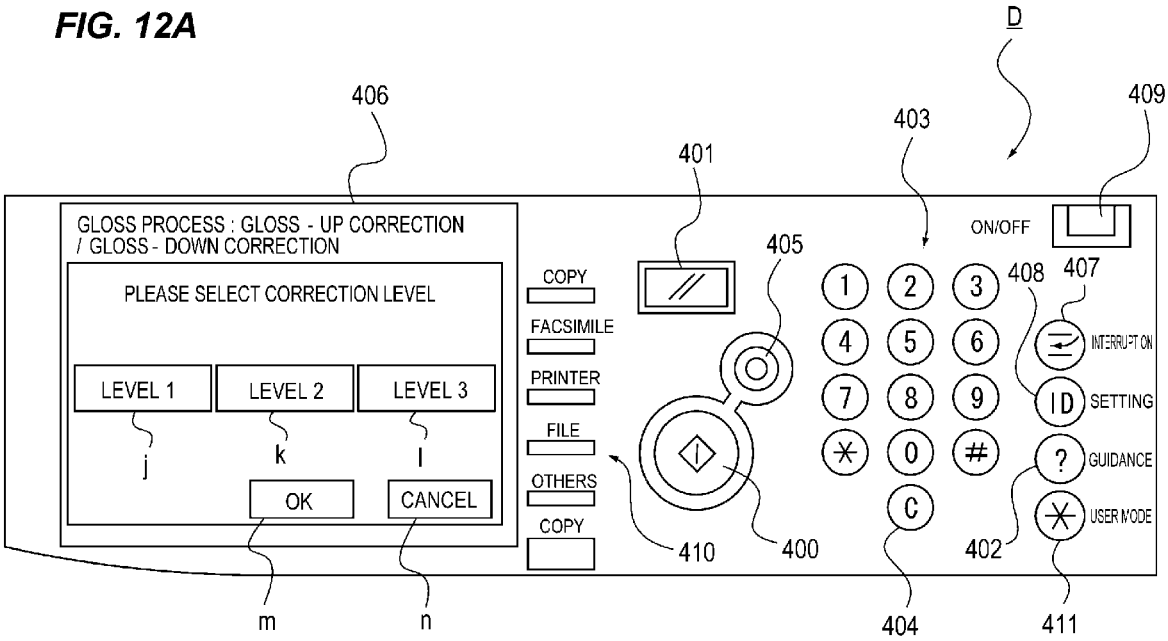
FIG. 12A is a plan view of the operation portion in a state that a screen for instructing to select a glossiness level is displayed at the display portion in a second embodiment.

In the copy mode, the correction level is designated as follows. The operations until the selecting of a gloss correction mode (i.e., gloss-up or gloss-down) and the reading of an original image and a gloss assignment original image inclusive are performed with the same operational procedure as described in the first embodiment with reference to FIGS. 2B, 2C, 4A and 4B. Thereafter, the level designation is performed at the operation portion D. FIG. 12A illustrates a screen of the liquid crystal display portion 406 to perform the level designation. Any one of selection keys j, k, l of levels 1 to 3 is selected and an OK key m is pressed. Here, the correction level of level 2 indicates the correction level that the gloss of the assigned area described in the first embodiment is heightened or lowered by approximate 7% with the toner mount quantity of 0.5 mg/cm$^2$ (see FIGS. 6B and 10A). Accordingly, when level 2 is selected, the image forming process is performed by utilizing the tables of GMLUT(0)_1, GLUT(0)_1, GMLUT(0)_2, and GNLUT(0)_2 as illustrated in FIGS. 5A to 5D in the case of the gloss-down correction mode, as described in the first embodiment. Meanwhile, in the case of the gloss-up correction mode, the image forming process is performed by utilizing the tables of GMLUT(1)_1, GNLUT(1)_1, GMLUT(1)_2, and GNLUT(1)_2 as illustrated in FIGS. 9A to 9D. Here, level 1 denotes a case that the range of gloss-up or gloss-down of the assigned area is set to be smaller than that of level 2 (i.e., the first embodiment). Level 3 denotes a case that the range of gloss-up or gloss-down of the assigned area is set to be larger than that of level 2 (i.e., the first embodiment). When level 1 or level 3 is selected, the image forming process is performed by utilizing look-up tables being different from the above discussed look-up tables. In the second embodiment, the screen of FIG. 12A automatically appears after the operation described with FIGS. 2B, 2C, 4A and 4B is performed. Since the operation is similar to that of the first embodiment before the gloss correction level is designated, FIGS. 2 and 4 and the operational procedure thereof are referred to.

Figure 12B:
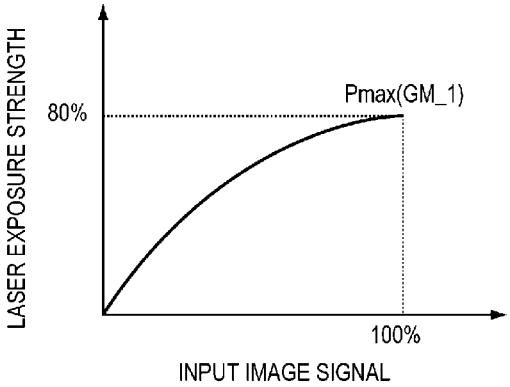
FIGS. 12B to 12E are views which illustrate look-up tables of correction level 1 of the gloss-down correction mode in the second embodiment.
Figure 12C:
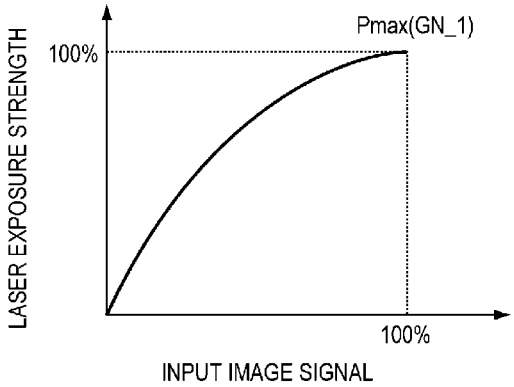
Figure 12D:
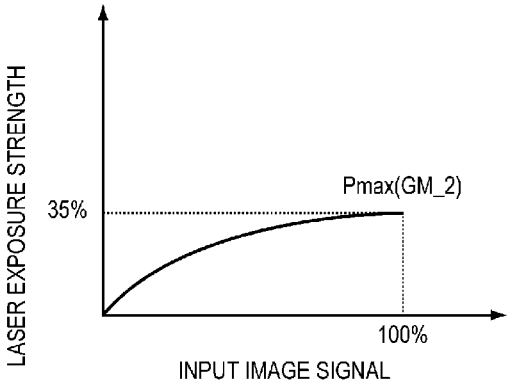
Figure 12E:
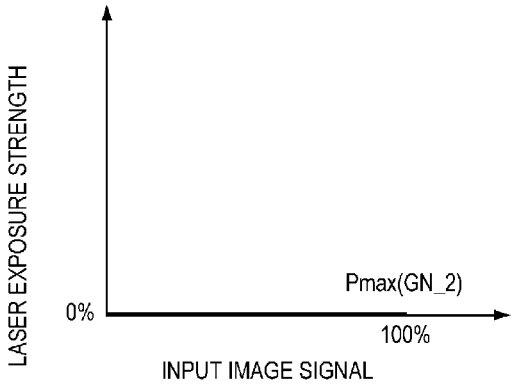

Next, the look-up tables will be described. Here, a description will be provided only in the cases that level 1 and level 3 are selected as the correction level of the gloss-down correction mode. The RAM 201 stores input image information and a table GMLUT(2) of laser exposure strength for the gloss control target pixels GM and input image information and a table GNLUT(2) of laser exposure strength for the non-gloss control target pixels GN for the case that level 1 is selected. The table GMLUT(2) includes two types of tables of a table GMLUT(2)_1 to be used in the first image forming process and a table GMLUT(2)_2 to be used in the second image forming process. The table GNLUT(2) includes two types of tables of a table GNLUT(2)_1 to be used in the first image forming process and a table GNLUT(2)_2 to be used in the second image forming process. FIGS. 12B to 12E are views illustrating the tables GMLUT(2)_1, GNLUT(2)_1, GMLUT(2)_2 and GNLUT(2)_2 in the case that correction level 1 is selected in the gloss-down correction mode of the present embodiment. FIG. 12B illustrates the table GMLUT(2)_1, FIG. 12C illustrates the table GNLUT(2)_1, FIG. 12D illustrates the table GMLUT(2)_2, and FIG. 12E illustrates the table GNLUT(2)_2.

According to FIGS. 12B to 12E and 6A, at the gloss control target pixels GM, image forming is performed as follows based on the table GMLUT(2)_1. That is, in the first image forming process, image forming is performed under the condition that three quarter toner quantity of 0.375 mg/cm$^2$ of the maximum toner mount quantity of 0.5 mg/cm$^2$ is to be the maximum toner mount quantity. Then, fixing is performed with the first fixing process. In the second image forming process, image forming is performed under the condition that the residual toner quantity of 0.125 mg/cm$^2$ is to be the maximum toner mount quantity based on the table GMLUT(2)_2. Subsequently, the final output image is obtained with the second fixing process. Meanwhile, at the non-gloss control target pixels GN, image forming is performed in the first image forming process under the condition that the maximum toner mount quantity of 0.5 mg/cm$^2$ is to be the maximum toner mount quantity based on the table GNLUT(2)_1. In the second image forming process after being fixed with the first fixing process, image forming with toner is not performed, that is, the so-called blank image forming is performed, based on the table GNLUT(2)_2. Subsequently, the final output image is obtained with the second fixing process.

Figure 13A:
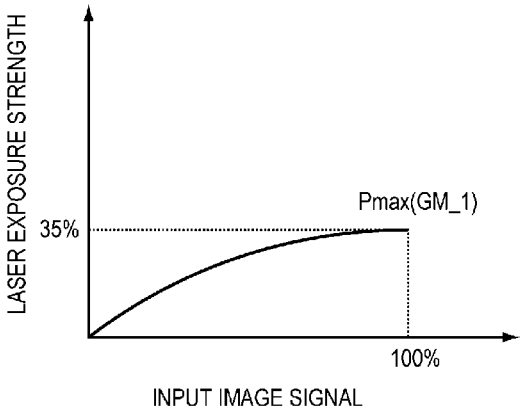
FIGS. 13A to 13D are views which illustrate look-up tables of correction level 3 of the gloss-down correction mode in the second embodiment.
Figure 13B:
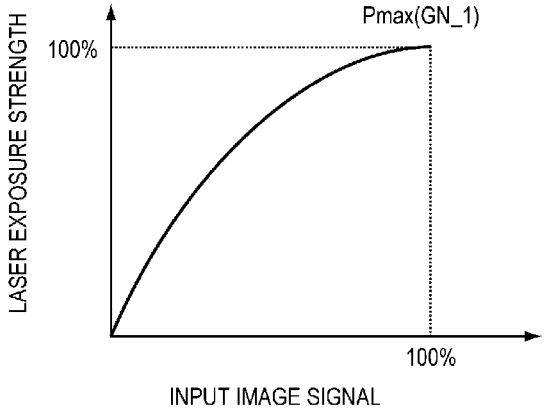
Figure 13C:
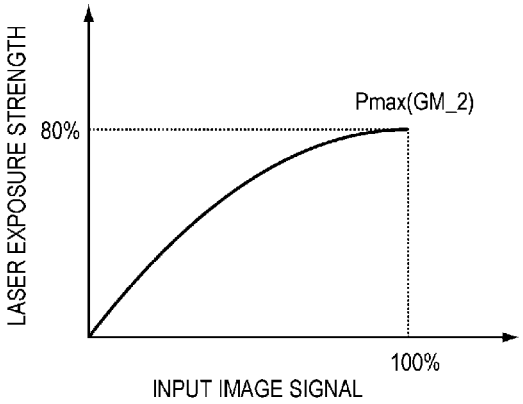
Figure 13D:
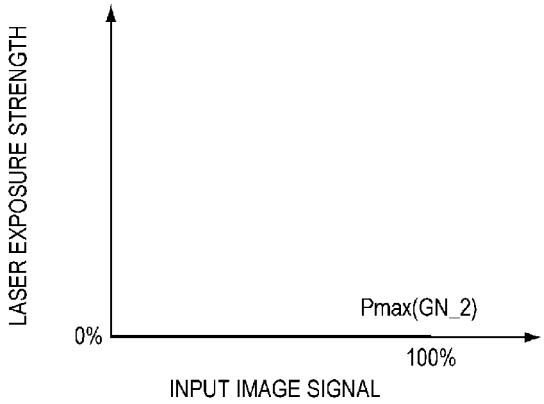

FIGS. 13A to 13D are views illustrating the tables GMLUT(3)_1, GNLUT(3)_1, GMLUT(3)_2 and GNLUT(3)_2 in the case that correction level 3 is selected in the gloss-down correction mode of the present embodiment. FIG. 13A illustrates GMLUT(3)_1, FIG. 13B illustrates GNLUT(3)_1, FIG. 13C illustrates GMLUT(3)_2, and FIG. 13D illustrates GNLUT(3)_2. According to FIGS. 13A to 13D and 6A, at the gloss control target pixels GM, image forming is performed as follows based on the table GMLUT(3)_1. That is, in the first image forming process, image forming is performed under the condition that a quarter toner quantity of 0.125 mg/cm$^2$ of the maximum toner mount quantity of 0.5 mg/cm$^2$ is to be the maximum toner mount quantity. Then, fixing is performed with the first fixing process. In the second image forming process, image forming is performed under the condition that the residual toner quantity of 0.375 mg/cm$^2$ is to be the maximum toner mount quantity based on the table GMLUT(3)_2. Subsequently, the final output image is obtained with the second fixing process. Meanwhile, at the non-gloss control target pixels GN, image forming is performed in the first image forming process under the condition that the maximum toner mount quantity of 0.5 mg/cm$^2$ is to be the maximum toner mount quantity based on the table GNLUT(3)_1. In the second image forming process after being fixed with the first fixing process, image forming with toner is not performed, that is, the so-called blank image forming is performed, based on the table GNLUT(3)_2. Subsequently, the final output image is obtained with the second fixing process.

Figure 14A:
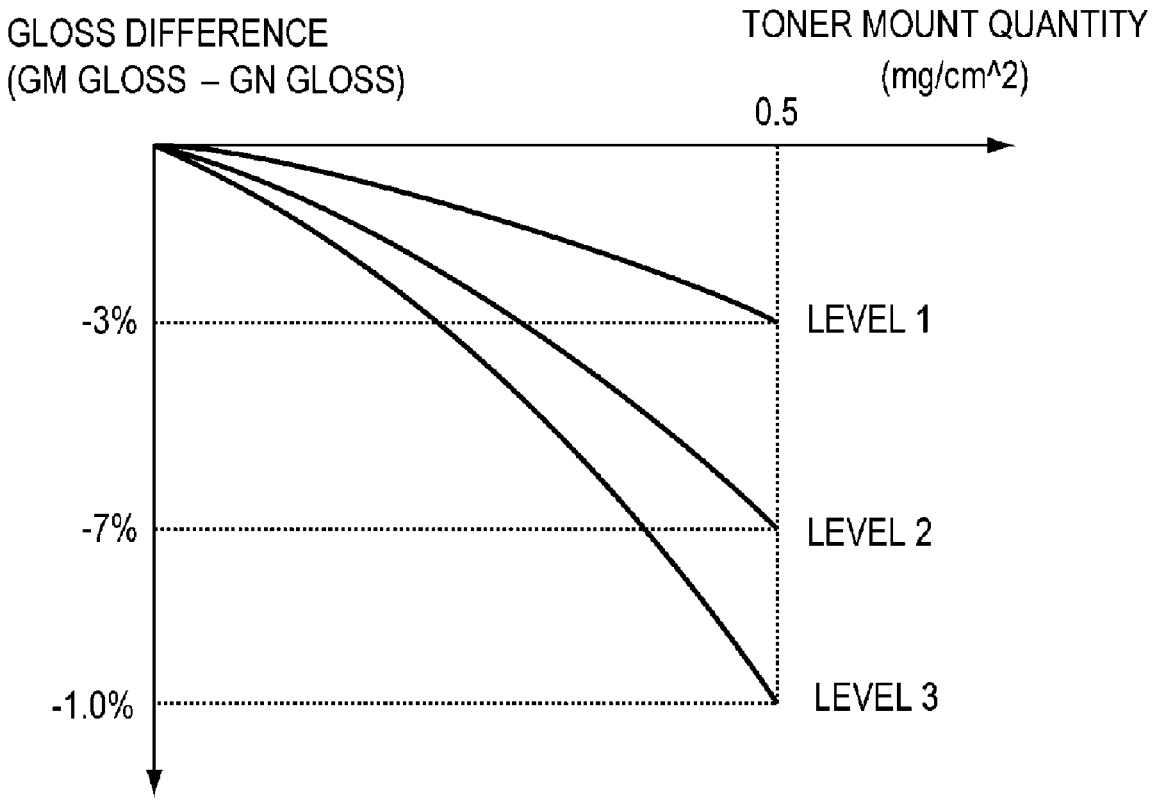
FIG. 14A is a view which illustrates a gloss-down range in the second embodiment.

FIG. 14A is a graph indicating the gloss difference among cases utilizing look-up tables respectively corresponding to the correction levels of level 1, level 3, and level 2 described in the first embodiment. That is, the graph indicates the gloss difference between the gloss-down correction area constituted with the gloss control target pixels GM and another area constituted with non-gloss control target pixels GN for each level. The gloss of the gloss control target pixels GM having the gloss-down correction assigned thereto is lowered with respect to the gloss of the non-gloss control target pixels GN being the other image area. That is, at the toner quantity of 0.5 mg/cm$^2$, the gloss is lowered by approximate 3% in level 1, by approximate 7% in level 2, and by approximate 10% in level 3. The following description explains the reason why the gloss-down range can be changed by changing the look-up tables for the gloss control target pixels GM in the case that the gloss-down correction level is changed. That is, the flatness of the toner layer surface shape is controlled in the fixing process by controlling the toner quantity receiving the fixing process only once used for the second image forming for the gloss control target pixels GM. In short, the larger the layer thickness of a toner layer receiving the fixing process only once, the more difficult it is to form a smooth surface with one time of the fixing process. Accordingly, when a correction having a large gloss difference is selected as correction level 3, the toner quantity mounted on the gloss control target pixels GM in the second image forming process is relatively increased.

Figure 14B:
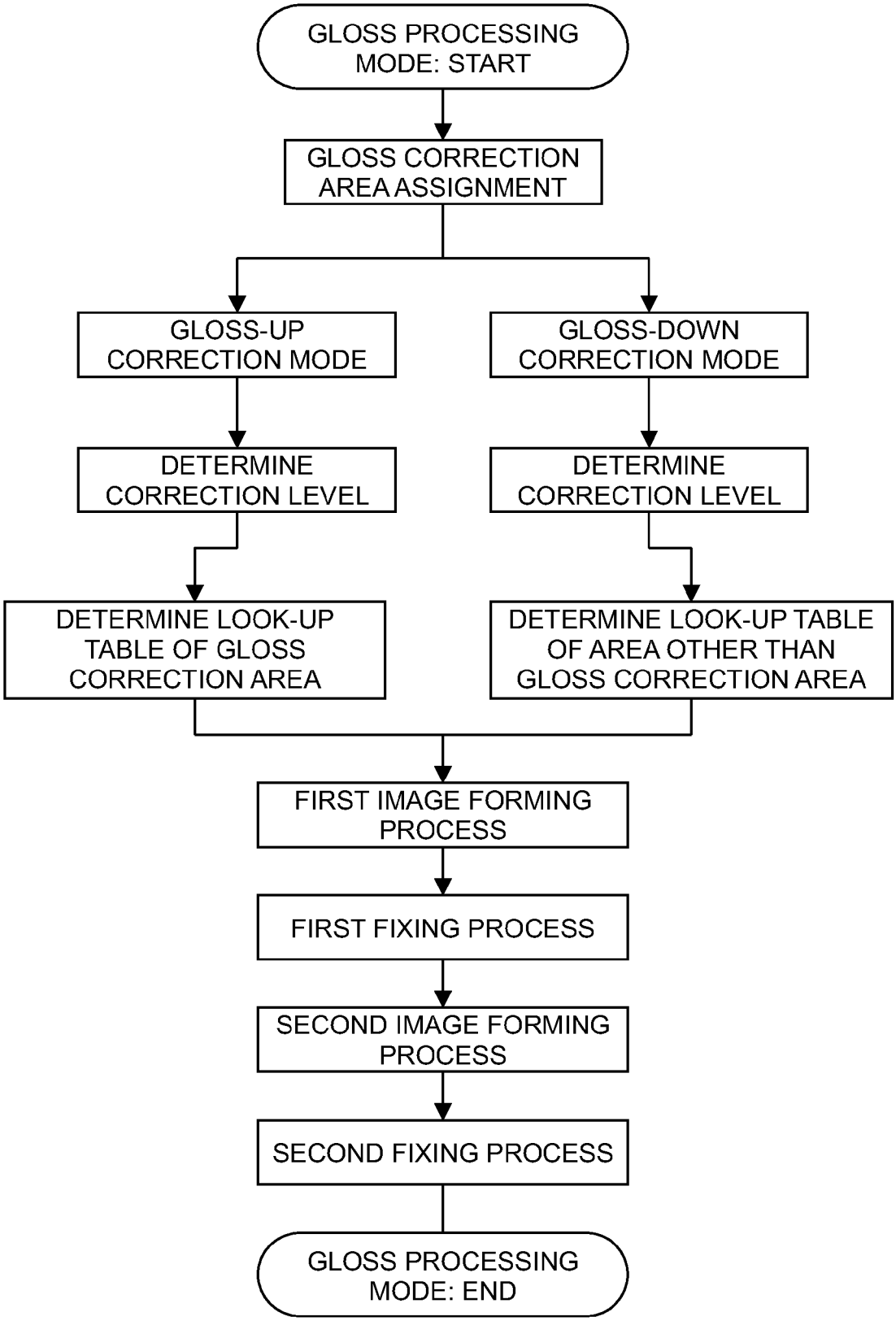
FIG. 14B is a flowchart which describes the control flow in the second embodiment.

The above description has been provided on the gloss-down correction mode. Since the gloss-up correction mode is possible to be performed by utilizing different look-up tables similarly to the first embodiment, the description thereof will not be repeated. As described above, by preparing plural look-up tables for gloss correction levels and utilizing the tables according to levels, an image forming apparatus capable of controlling the level of gloss-up and gloss-down without using clear toner can be provided. FIG. 14B is a flowchart describing a method for forming a gloss-up correction area and a gloss-down correction area and a method of level correction thereof in the present embodiment.

[Third Embodiment]

The first and second embodiments are exemplified with a monochrome image forming apparatus. The present invention is capable of forming an output image of a color image having a gloss-up area and a gloss-down area with a color image forming apparatus as well. That is, assorted usage of the look-up tables of the laser exposure strength against input image signals as described in the first and second embodiments is performed in image forming portions of respective colors. This configuration enables the formation of an output image of a color image having a gloss-up area and a gloss-down area. In the following description of the present embodiment, the present invention is adapted to a color image forming apparatus.

Figure 15:
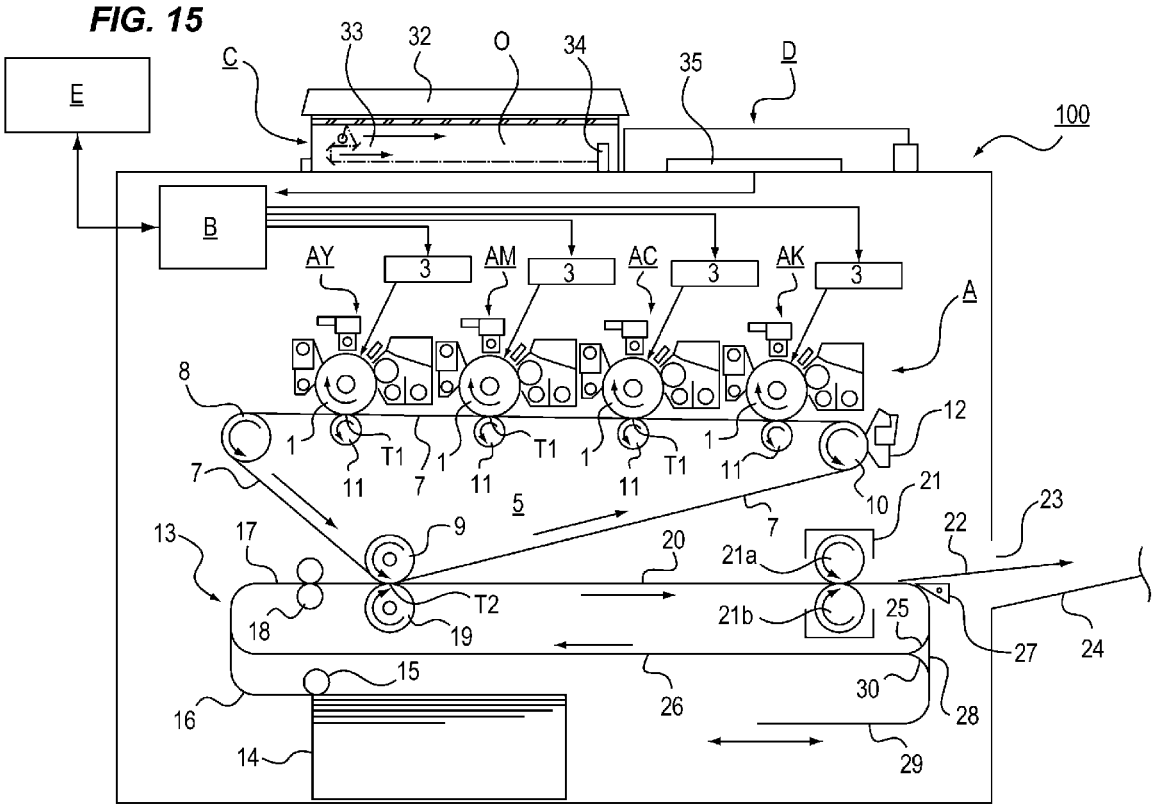
FIG. 15 is a schematic sectional view of a color image forming apparatus according to the third embodiment.

FIG. 15 is a schematic sectional view of a color image forming apparatus 100 according to the present embodiment. The apparatus 100 is a digital color image forming apparatus of an electrophotographic system to form a full-color toner image with black (K) toner, cyan (C) toner, magenta (M) toner and Yellow (Y) toner. A description will not be repeated on the structural members and components commonly used in the digital monochrome image forming apparatus of FIG. 1A, which are given same reference numerals. The image forming portion A is provided with four image forming portions of the first to the fourth image forming portions AK, AC, AM, and AY arranged from the right side to the left side in FIG. 15. Each image forming portion is an electrophotographic image forming mechanism being similar to the image forming portion A of the image forming apparatus of FIG. 1A. A black toner image is formed on the drum 1 at the first image forming portion AK. A cyan toner image is formed on the drum 1 at the second image forming portion AC. A magenta toner image is formed on the drum 1 at the third image forming portion AM. A yellow toner image is formed on the drum 1 at the fourth image forming portion AY. Then, the toner image formed on the drum of each image forming portion is primarily transferred in sequence to the intermediate transfer belt 7 as being superimposed in a predetermined manner. Thus, a full-color toner image is formed on the belt 7 as superimposing black toner, cyan toner, magenta toner and yellow toner. The full-color toner image is secondarily transferred collectively to a recording material P at the secondary transfer nip portion T2. The recording material P is guided to the fixing device 21 and receives a toner image fixing process, and then, is output as a full-color image-formed product.

In the partial gloss-down processing mode or the partial gloss-up processing mode, a recording material having been subjected to the first image forming process and the first fixing process is guided to the re-conveying path 26 and guided to the secondary transfer nip portion T2 once again, being similar to the first embodiment. The toner image formed on the belt 7 is transferred to the recording material in the second image forming process at the nip portion T2. Then, the recording material is guided to the fixing device 21 once again and receives the second fixing process so as to be output as a final output image. In the gloss processing mode (i.e., the partial gloss-down processing mode and the partial gloss-up processing mode), the first and second image forming processes are performed as follows. Assorted usage of the look-up tables of the laser exposure strength against input image signals as described in the first and second embodiments is performed on the respective image forming portions. Thus, an output image of a color image having a gloss-up area and a gloss-down area is formed. Here, a brief description will be provided in the case that the partial gloss-down mode is selected at an area selected from an image forming area of two colors of yellow toner and magenta toner. Similar to the first embodiment, each pixel in the selected area is defined as the gloss control target pixel GM and each pixel in other areas is defined as the non-gloss control target pixel GN. A RAM (not illustrated) of the controller B stores input image information and a look-up table GM-Y-LUT(0) of the laser exposure strength of the gloss control target pixels GM for yellow. Further, the RAM stores input image information and a look-up table GN-Y-LUT(0) of the laser exposure strength of the non-gloss control target pixels GN for yellow. Furthermore, the RAM also stores input image information and a look-up table GM-M-LUT(0) of the laser exposure strength of the gloss control target pixels GM and input image information and a look-up table GN-M-LUT(0) of the laser exposure strength of the non-gloss control target pixels GN for magenta. The table GM-Y-LUT(0) includes two types of tables of a table GM-Y-LUT(0)_1 to be used in the first image forming process and a table GM-Y-LUT(0)_2 to be used in the second image forming process. Further, the table GN-Y-LUT(0) includes two types of tables of a table GN-Y-LUT(0)_1 to be used in the first image forming process and a table GN-Y-LUT(0)_2 to be used in the second image forming process. The table GM-M-LUT(0) includes two types of tables of a table GM-M-LUT(0)_1 to be used in the first image forming process and a table GM-M-LUT(0)_2 to be used in the second image forming process. Further, the table GN-M-LUT(0) includes two types of tables of a table GN-M-LUT(0)_1 to be used in the first image forming process and a table GN-M-LUT(0)_2 to be used in the second image forming process.

Figure 16A:
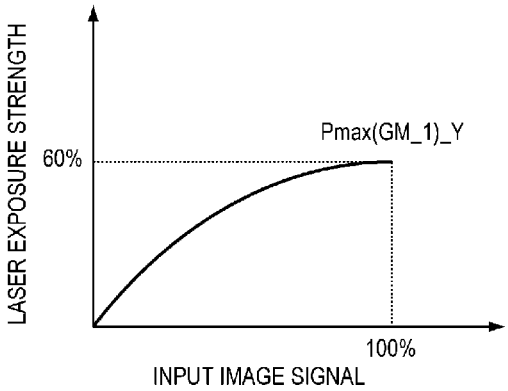
FIGS. 16A to 16H are views which illustrate look-up tables of the gloss-down correction mode in the third embodiment.
Figure 16B:
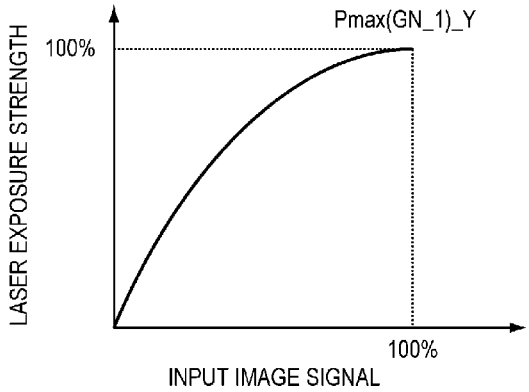
Figure 16C:
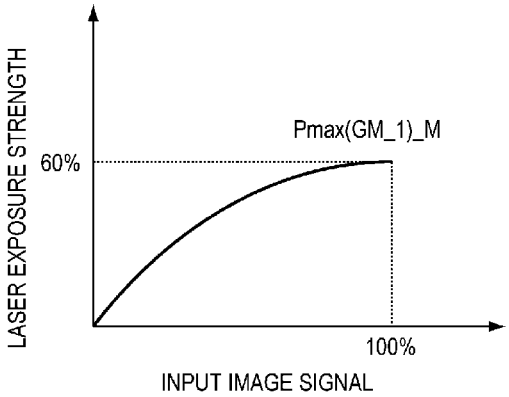
Figure 16D:
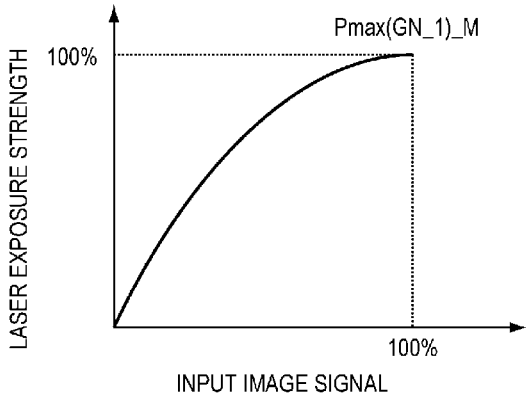
Figure 16E:
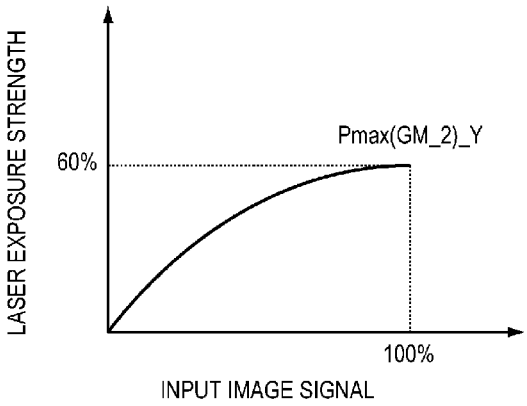
Figure 16F:
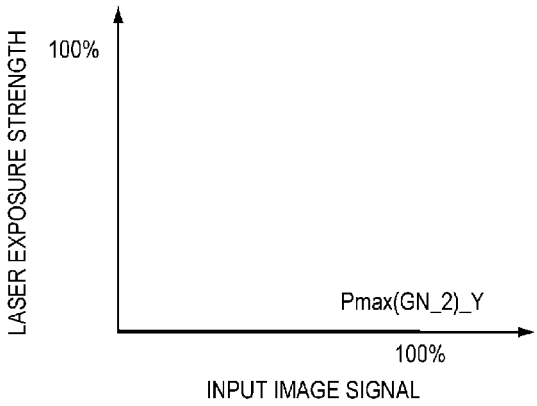
Figure 16G:
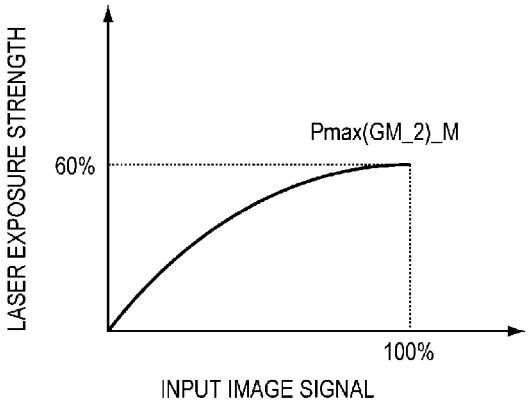
Figure 16H:
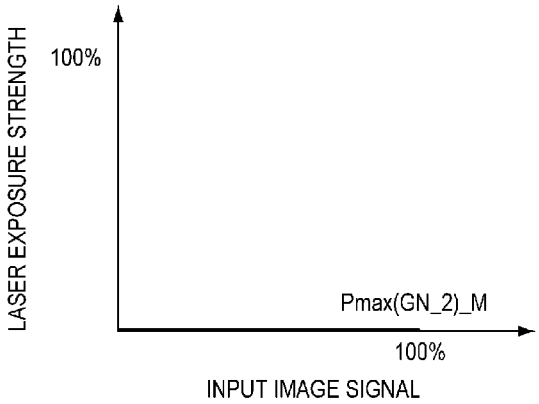

FIGS. 16A to 16H are views illustrating the respective tables in the present embodiment. FIG. 16A illustrates the table GM-Y-LUT(0)_1, FIG. 16B illustrates the table GN-Y-LUT(0)_1, FIG. 16C illustrates the table GM-M-LUT(0)_1, and FIG. 16D illustrates the table GN-M-LUT(0)_1. Further, FIG. 16E illustrates the table GM-Y-LUT(0)_2, FIG. 16F illustrates the table GN-Y-LUT(0)_2, FIG. 16G illustrates the table GM-M-LUT(0)_2, and FIG. 16H illustrates the table GN-M-LUT(0)_2. According to FIGS. 16A, 16C, 16E and 16G, image forming is performed at the gloss control target pixels GM as follows. That is, in the first image forming process, image forming is performed under the condition that a half toner quantity of 0.25 mg/cm$^2$ of the maximum toner mount quantity of 0.5 mg/cm$^2$ is to be the maximum toner mount quantity in both yellow and magenta based on the tables GM-Y-LUT(0)_1 and GM-M-LUT(0)_1. Then, fixing is performed with the first fixing process. In the second image forming process, image forming is performed under the condition that the residual half toner quantity of 0.25 mg/cm$^2$ is to be the maximum toner mount quantity based on the tables GM-Y-LUT(0)_2 and GM-M-LUT(0)_2. Subsequently, the final output image is obtained with the second fixing process. Meanwhile, according to FIGS. 16B, 16D, 16F and 16H, image forming is performed at the non-gloss control target pixels GN as follows. In the first image forming process, image forming is performed under the condition that the maximum toner mount quantity of 0.5 mg/cm$^2$ for each of yellow and magenta, that is 1.0 mg/cm$^2$ in total of two colors, is to be the maximum toner mount quantity based on the tables GN-Y-LUT(0)_1 and GN-M-LUT(0)_1. In the second image forming process after being fixed with the first fixing process, image forming with toner is not performed in both yellow and magenta, that is, the so-called blank image forming is performed, based on the tables GN-Y-LUT(0)_2 and GN-M-LUT(0)_2. Subsequently, the final output image is obtained with the second fixing process.

Figure 17A:
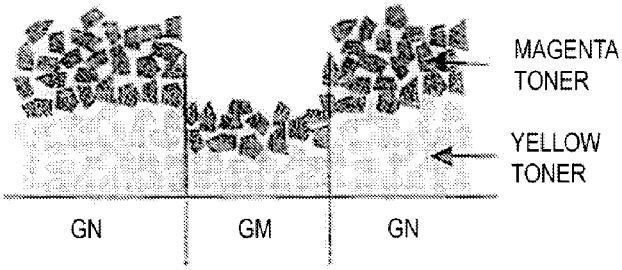
FIGS. 17A to 17D are schematic views for describing the reason why gloss-down can be performed in the third embodiment.
Figure 17B:
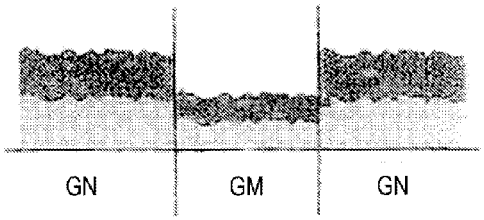
Figure 17C:
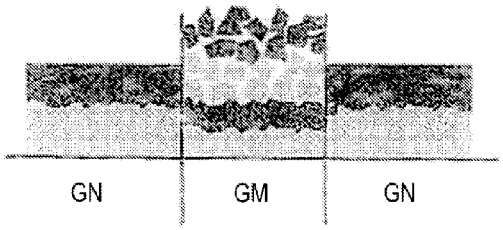
Figure 17D:
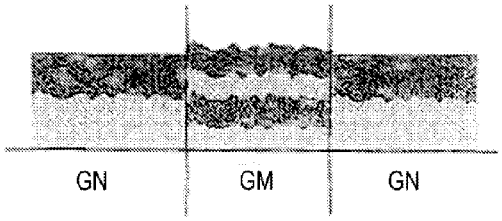

As described above, at the gloss control target pixels GM, toner is mounted on a recording material by being divided into two image forming processes. Meanwhile, at the non-gloss control target pixels GN, all toner is mounted in the first image forming process in all colors. Accordingly, the gloss of the gloss control target pixels GM is to be lower than that of the non-gloss control target pixels GN. That is, a final output image having low gloss only at the gloss-down correction area as the assigned area can be obtained. FIGS. 17A to 17D are schematic views illustrating states of toner mounted on a recording material at the area of the gloss control target pixels GM and at the area of the non-gloss control target pixels GN in the gloss-down correction mode. FIG. 17A illustrates a state of toner after the first image forming process. FIG. 17B illustrates a state of toner after the first fixing process. FIG. 17C illustrates a state of toner after the second image forming process. FIG. 17D illustrates a state of toner after the second fixing process. As can be seen, the toner surface layer part in the area of the gloss control target pixels GM receiving the fixing process only once is shaped to be rougher with asperity, that is, to be shaped with lower gloss, than the toner surface layer part in the area of the non-gloss control target pixels GN receiving the fixing process twice. In this manner, gloss at the area of the gloss control target pixels GM can be lowered from that at the area of the non-gloss control target pixels GN. Accordingly, it is possible to obtain the final output image having lowered gloss at an assigned area in the gloss-down correction mode.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-188457, filed Aug. 17, 2009, which is hereby incorporated by reference herein in its entirety.

What is claimed is:

1. An image forming apparatus comprising:

an image forming portion which forms an image with colored toner on a sheet;

a fixing device configured to fix the image formed on the sheet;

an obtaining unit configured to obtain an area whose glossiness is to be relatively heightened in the image formed on the sheet; and a controller configured to control the apparatus to form the image on the sheet with a first process to transfer and fix, onto the sheet, a part of colored toner for image forming when forming the image on the sheet and a second process to transfer and fix, onto a face of the sheet having the image formed thereon with the first process, a part of colored toner for image forming;

wherein said controller controls the apparatus so that a ratio (M2/M1) of a toner quantity (M2) formed in the second process at the area obtained by said obtaining unit to a toner quantity (M1) formed in the first process at the area obtained by said obtaining unit is to be smaller than a ratio (N2/N1) of a toner quantity (N2) formed in the second process at an area excluding the area obtained by said obtaining unit to a toner quantity (N1) formed in the first process at the area excluding the area obtained by said obtaining unit.

2. The image forming apparatus according to claim 1, further comprising a designation unit configured to designate a stepwise gloss difference between the area obtained by said obtaining unit and an area excluding the obtained area, wherein said controller changes an image forming condition of the first process and an image forming condition of the second process corresponding to a degree of the glossiness difference designated by said designation unit.

* * * * *